United States Patent [19]

Yamaguchi et al.

[11] Patent Number: 4,458,244

[45] Date of Patent: Jul. 3, 1984

[54] SELF SHIFT TYPE GAS DISCHARGE PANEL DRIVING SYSTEM

[75] Inventors: Hisashi Yamaguchi, Hyogo; Kazuo Yoshikawa, Hyogo; Keizo Kurahashi, Hyogo, all of Japan.

[73] Assignee: Fujitsu Limited, Kawasaki, Japan

[21] Appl. No.: 258,785

[22] Filed: Apr. 29, 1981

[30] Foreign Application Priority Data

Apr. 30, 1980 [JP] Japan ..... 55-58899
Apr. 30, 1980 [JP] Japan ..... 55-58898

[51] Int. Cl.[3] ..... G09G 3/28

[52] U.S. Cl. ..... 340/768; 340/713; 340/769; 340/805; 315/169.2

[58] Field of Search ..... 340/713, 714, 768, 769, 340/758, 805; 315/169.2

[56] References Cited

U.S. PATENT DOCUMENTS 3,877,006 4/1975 Reboul et al. ..... 340/714
3,991,341 11/1976 Ngo ..... 340/768
4,051,409 9/1977 Graycraft ..... 340/768
4,233,544 11/1980 Coleman ..... 340/768
4,257,068 3/1981 Johnson ..... 340/768
4,283,660 8/1981 Curry ..... 340/768
4,336,535 6/1982 Albertine, Jr. ..... 340/768

*Primary Examiner*—Marshall M. Curtis
*Attorney, Agent, or Firm*—Staas & Halsey

[57] ABSTRACT

An improved driving system for write operations into shift rows in a multi-row self shift type gas discharge panel. Each shift row is composed of at least one shift channel comprising a regular arrangement of plural shift discharge cells and which is provided with a write electrode which defines a write discharge cell at one end of the shift channel. To the write electrodes of the shift rows, the write voltage pulse is supplied in common. When applying the write voltage pulse to the write electrode of a selected shift row, a shift voltage pulse which is the same in polarity as said write voltage pulse and has an equivalent or greater time width than said write voltage pulse is applied to the shift electrode opposing the write electrodes of the non-selected shift rows, and as a result, erroneous discharges, namely, over-write to the adjacent shift discharge cells, can be avoided by preventing the discharge of the write discharge cells of the non-selected shift rows.

27 Claims, 21 Drawing Figures

SC1

SC1

SC2

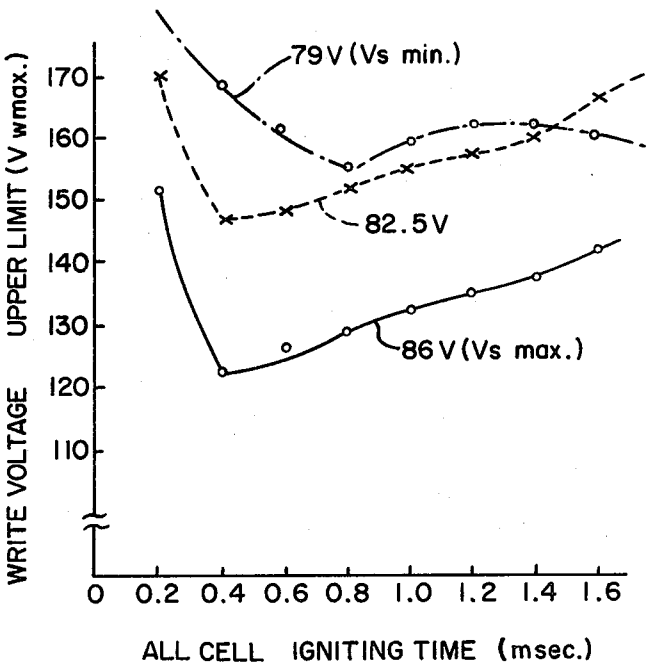
FIG. 8.
FIG. 10.
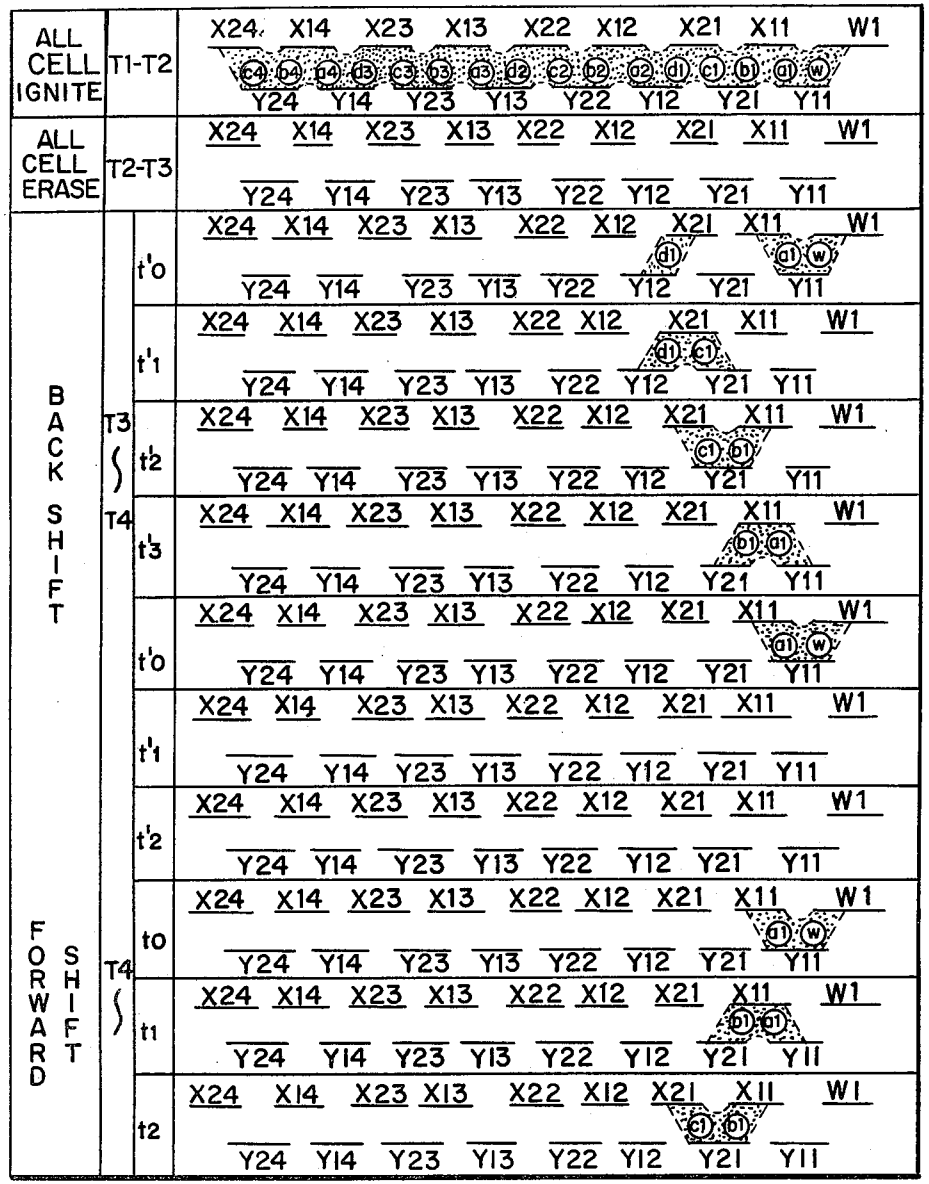

SELF SHIFT TYPE GAS DISCHARGE PANEL DRIVING SYSTEM

BACKGROUND OF THE INVENTION

The present invention relates to a newly developed driving system for data writing which prevents the problem of over write into non-selected display rows (shift rows) in a self shift type gas discharge panel, and particularly in a multi-row display panel.

The self shift type gas discharge panel of the present invention belongs to the field of gas discharge panels with an AC memory driving system wherein the information written in the form of discharge spots is shifted to the other end from the write end of the shift channel in such a manner that one period of the shift discharge cell arrangement is considered as one picture element and during the shift process a static display can be obtained by stopping the shift operation at particular discharge cell groups. Up to now, a variety of types have been conventionally proposed. Such a panel has an advantage that it can be reduced in size more than the ordinary display unit utilizing a CRT, in addition to excellent display functions based on the memory operation. Therefore, it is often employed as a monitor display and a keyboard display used for terminals of computer systems. The self shift display using such a panel is mainly intended for multi-row display, and the structure allows independent shift operation for display rows. For example, display data in non-selected display rows may be held at a specified location while new characters are written in or an update is carried out in selected display rows.

In such a multi-row display, the driving circuit is generally simplified and reduced in size by providing in common the write drivers for the write electrodes of the display rows.

However, when writing data into the selected display rows, such a structure allows the discharge spots to be generated also simultaneously at the write discharge cells of the non-selected display rows. Namely, such a structure has a disadvantage that an extra discharge, the so-called over-write, is generated at said shift discharge cells of the non-selected display rows in accordance with the condition of a wall charge at the surface of a dielectric layer corresponding to the shift discharge cells which are in-phase with said write discharge cells and adjacent to them. This over-write phenomenon will be explained in more detail by making reference to the multi-row display self shift type gas discharge panel providing the meander electrode structure proposed in U.S. Pat. No. 4,190,788 by Yoshikawa et al., assigned to the same assignee as the present invention. FIG. 1 schematically shows the electrode arrangement of such a panel. In this case, two shift channels SC1 and SC2 are represented in order to simplify the explanation, and a single display row is configured by a single shift channel. Each of these shift channels is formed between two respective Y electrode groups y1i, y2i (i is a positive integer) which are alternately arranged on the not illustrated lower substrate and have the meander pattern and two respective X electrode groups x1j, x2j (j is a positive integer) which are alternately arranged on the side of the upper substrate opposing said Y electrode groups. The surfaces of said electrodes are coated with a dielectric layer on the respective substrates, and the write electrodes W1, W2 are provided for the channels adjacent to the extreme right electrode x11 belonging to one X electrode group and opposing the extreme right electrode y11 of one Y electrode group. Thus the four groups of discharge cells ai, bi, ci and di are formed with 4-phases (phase A to phase D), between opposing portions of the electrodes, which are connected in common alternately and regularly and periodically arranged within the discharge gas space, and thereby the discharge spots generated by the write discharge cells w can be shifted sequentially along the arrangement of these discharge cells. Here, each write discharge cell w is formed on each shift channel between opposing portions of the write electrodes W1, W2 and the shift electrode y11 of each shift channel as a normal write discharge cell, and the write discharge area w' of the surface discharge mode is formed between the adjacent portion of each write electrode $W_1$, $W_2$ and the respective shift electrode x11 of each shift channel on the same substrate.

In the multi-row display structure, said two Y electrode groups are individually led out to two buses for each row (shown as Yj1, Yj2 for the jth shift channel or row, with j=1, 2, 3, etc) in order to make possible the shift operation of discharge spots for each display row, and these buses are connected individually to the Y shift drivers (not illustrated). Moreover, said two X electrode groups are respectively led out to the buses indicated as X1 and X2, with all display rows being connected in common as to these two electrode groups. Further, as explained above, said write electrode groups are led out with corresponding electrodes in each display row being connected in common and then connected to the corresponding write drivers (not illustrated).

In such a multi-row display self shift type gas discharge panel, while the shift operation is being carried out in order to write information into the selected write rows, the information already written into the non-selected display rows is kept in the display condition by the sway shift system (operation) in view of improving display quality.

FIGS. 2(A)–(D) show the driving voltage waveforms for attaining the shift operation and sway shift operation in the plurality of display rows. In this figure, in regard to the 1st, 2nd display rows (shift channels) SC1, SC2, the first display row SC1 is selected and the second display row SC2 is in the non-selected condition. FIGS. 2(A) and (C) show the electrode voltage waveforms applied to electrodes of the selected 1st display row and non-selected 2nd display row through the indicated buses, while FIGS. 2(B) and (D) show the cell voltage waveforms which are applied as the combined waveforms of said voltages applied to the electrodes of the discharge cell groups between the indicated electrodes of the 1st and 2nd display rows. As is apparent from these figures, the shift operation of the gas discharge panel having the meander electrode structure is carried out in such a way that four basic pulse trains indicated as ① to ④ in the four steps $t_0$ to $t_3$ are distributed in the sequentially rotating illustrated manner to the plural buses. It is supposed, for example, that each display row is set in the static display mode (fixed mode) during the period from $T_0$ to $T_1$ as shown, in which the common shift voltage pulse SP is applied to the buses Y11 and Y21 for the two groups of Y electrodes of each row, and the shift voltage pulses SP with equal phase are applied to the two buses X1 and X2 for the X electrodes. On the other hand, the shift voltage pulses SP which have a phase difference of $\tau_e$, corresponding to the time width of an erase voltage pulse after the rising and falling edges of the shift voltage pulses SP of the buses of the X electrodes, are applied to the buses Y12 and Y22 for the other Y electrodes of the display rows. As a result, the illustrated AC shift voltage pulse trains are applied to the adjacent discharge cell groups di and ai of the phases D and A of the display rows, while the narrow erase voltage pulses EP as indicated in FIG. 2(B) are applied by means of said phase difference $\tau_e$ to the remaining adjacent discharge cell groups bi and ci of the phases B and C. Therefore, the information of each display row written before the period from $T_0$ to $T_1$ is held at the adjacent two discharge cells di and ai in such a manner as to occupy in common a pair of adjacent discharge spots.

If data writing is required for the selected 1st display row SC1 in this static display mode, the following operation is performed. The write operation is carried out in the step in wherein the discharge cells di and ai of phases D and A are activated during one cycle of the shift operation consisting of the four steps $t_0$ to $t_3$. Namely, with reference to the step $t_0$ in FIGS. 2(A) and (C), the write voltage pulses WP based on the common write information are applied to the write electrodes W1 and W2. Thereby, the write voltage waveforms indicated by w, w' are applied to the write discharge cell w and surface discharge write area w' of each display row. In other words, said write voltage pulse WP is applied directly as WP' to each write cell w, which provides as a result of cancellation the narrow pulse WP'' across the surface discharge write area w', and the first discharge spots are respectively generated at the desired write discharge areas. At this time, since the shift pulses SP as indicated are applied to the cells ai of the phase A group to which the first shift discharge cells a1 of both display rows SC1 and SC2 belong, the discharge spots are simultaneously generated at said shift discharge cells a1 adjacent to the write discharge cells w by means of the priming effect of said write discharge spot. The discharge spots generated at the discharge cell a1 spreads to the two adjacent discharge cells a1 and b1 of the phases A and B in accordance with the change-over of said basic pulse trains applied in the next step $t_1$. These discharge spots are, in the case of the selected 1st display row SC1, sequentially shifted to the other end (extreme left side) along the display row SC1 in such a manner that adjacent pairs of discharge cells b1 and c1, c1 and d1 are simultaneously discharged while the basic pulse trains as indicated are applied in the next steps $t_2$, $t_3$. During this period, the erase voltage pulse EP is effectively applied to the discharge cell groups from which the discharge spots are already shifted, and thereby the erase operation is carried out for the relevant discharge spots. The discharge spots of the discharge cells d2 and a3 which are written prior to this write operation are shifted sequentially as a3·b3→b3·c3→c3·d3—FIG. 3(A) schematically shows the write and shift operations of discharge spots in the selected rows in correspondence to the cell voltage waveforms of FIG. 2(B).

However, in the case of the non-selected 2nd display row SC2, since the basic pulse trains ① and ③ which are applied to the buses Y21 and Y22 of the Y side during the time $t_2$ are selected in the reverse relation to the basic pulse trains applied to the buses y11, Y12 of the Y side of said selected row SC1, the discharge spots located at said shift discharge cells a1 and b1 return to the cell a1 because the discharge cell groups of phases D and A are activated. In the next step $t_3$, the shift discharge cells of the phases D and C are activated as in the case of the selected rows, but the discharge spots are shifted backward in succession toward the reversely adjacent cells of phases D and C from the cells of phases D and A. Due to such a sway shift operation, the discharge spots in the non-selected rows, corresponding to the write information generated as in the case of the selected rows by the write operation, are erased in this timing because the erase voltage pulse EP is applied to the relevant shift cell a1. Prior to this write operation, the discharge spots of the written discharge cells d2 and a3 are held in such a manner that these spots are swayed to the right or left to occupy the adjacent pairs of cells in the sequence of a3·b3→a3·b2→d2·c2 by the basic pulse application in accordance with said sway shift operation mode. FIG. 3(B) schematically indicates the sway shift operation in the non-selected rows.

As explained above, the self shift type gas discharge panel for a multi-row display of this type employs the structure that even if the write discharge spots are generated in the non-selected display rows simultaneously with the selected display rows, they are erased automatically, and therefore result in no problem for the display functions. However, when considering the case where excessive charges are accumulated at the surface of the dielectric layer covering an electrode which is in the same phase as the write discharge cell w', for example, in the non-selected rows, corresponding to the shifting to the adjacent shift discharge cell d1 of the phase D (but located one shift period away from the write cell), the firing voltage of said shift cell d1 is lowered more than the ordinary value due to such excessive charges. This phenomenon will be explained in more detail. The gas discharge panel of this type has a particular problem in that the charges are excessively accumulated at both ends of the shift channels when the shift operation of the discharge spots is repeated, and thereby an abnormal discharge easily occurs due to unequal distribution of the accumulated wall charges. From such circumstances, when the discharge spot is generated at the write discharge cell w (and surface discharge write area w'), unwanted erroneous discharge, namely the over-write occurs also at the adjacent shift discharge cell $d_1$ by means of the priming effect and the shift voltage pulse at this time. Since this abnormal discharge spot which is not based on the information is not erased automatically, unlike the written discharge spot in each non-selected row, an erroneous display occurs, degrading the display quality of the panel.

This sway shift operation is explained in detail in U.S. Pat. No. 4,190,789 by Kashiwara et al. assigned to the same assignee as the present invention.

SUMMARY OF THE INVENTION

This invention offers an improved driving system for the self shift type gas discharge panel.

In more detail, it is an object of the present invention to offer a new driving system which assures an accurate write operation in the self shift type gas discharge panel.

It is another object to offer a new driving system which has an improved display quality by preventing generation of over-write at the non-selected display rows when writing data into the selected display rows in the self shift type gas discharge panel for multi-row display. Briefly, the present invention is characterized in a self shift type gas discharge panel for multi-row display wherein the write voltage pulse is supplied in common in the same sequence to the write electrodes of the plurality of display rows, so that when applying the write voltage pulse to the write electrodes of selected display rows, the write discharge at the non-selected display rows is prevented by applying a pulse voltage, which is the same in polarity as said write voltage pulse and has an equivalent or longer time period, to the shift electrodes opposing the write electrodes of the non-selected display rows. In short, the present invention is characterized in that the common write voltage pulse for the non-selected rows is effectively cancelled.

Further features and advantages of the present invention will be apparent from the following description of the preferred embodiments with reference to the accompanying drawings to which, however, the scope of the invention is in no way limited.

BRIEF DESCRIPTION OF THE DRAWINGS

FIG. 8 shows the operating margin characteristic in the case that an all-cell-ignite operation is performed for the panel of FIG. 1.

FIG. 10 schematically shows the write and shift modes at the selected display rows by the voltage waveforms of FIGS. 9(A) and (B).

DETAILED DESCRIPTION OF THE PREFERRED EMBODIMENTS

FIGS. 4(A) to (D) show driving voltage waveforms conforming to an embodiment of the present invention. According to the features of these waveforms, the write operation can be set to a very advantageous condition by setting the static display operation mode in such a condition that the shift cell groups bi and ci of the phases B and C are activated in all display rows. Namely, when focusing on the waveform in the period T0–T1 corresponding to the static display operation, the AC shift voltage pulses SP are applied to the cell groups bi, ci of the phases B and C, while the AC erase voltage pulses EP are applied to the cell groups di, ai of the phases D and A. Therefore, the discharge spots are generated continuously only at said cell groups bi and ci.

After this static display, in the write operation mode, the shift operation is carried out at the selected display row SC1, while the sway shift operation occurs at the non-selected display rows, as in the case above, starting from said discharge cell groups bi and ci. In addition, at the selected rows, the data is written correspondence with the timing for the discharge cell groups di and ai of the phases D and A during each cycle of said shift operation, as in the case of the conventional driving method. Namely, in the case of FIGS. 4(A) to (D), the step $t_1$ in the period $T_1$–$T_5$ corresponding to one shift operation provides the timing for activating the cell groups of phases D and A, and when the write voltage pulse WP' is applied to the write electrode $W_1$ of the selected row SC1 in the step $T_1$, the first discharge spot is generated at the selected write cell w (and surface discharge write area w') as explained previously. This discharge spot is shifted in the sequence of adjacent pairs of discharge cells a1·b1→b1·c1→—in the next steps $t_2$, $t_3$—, as explained above.

Figure 5A:
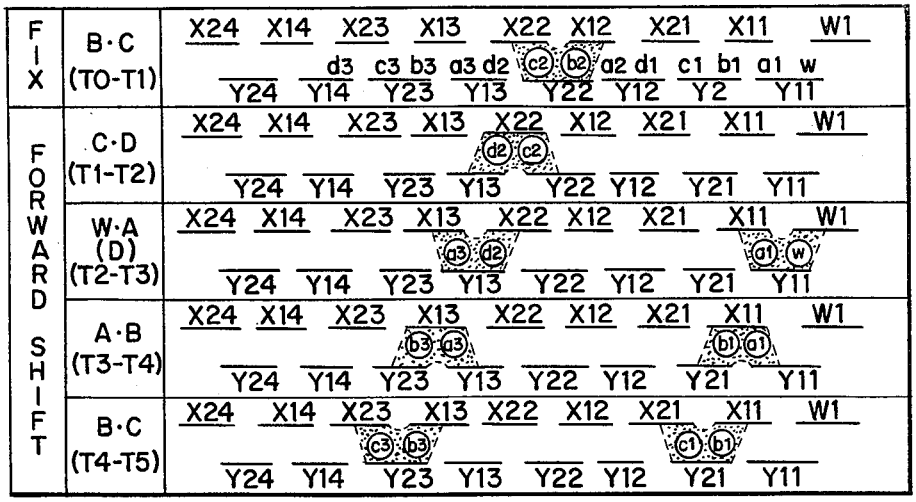
FIGS. 5(A) and (B) schematically show the write and shift modes at the selected display rows and the non-selected display rows by the voltage waveforms of FIGS. 4(B) and (D).

FIG. 5(A) schematically shows the movement of the discharge spots based on the write and shift operations in said selected display row SC1.

Figure 1:
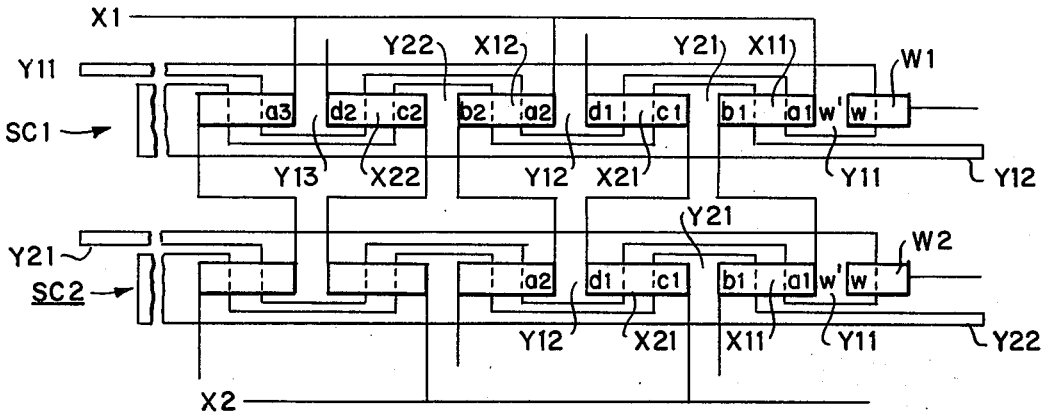
FIG. 1. PRIOR ART
FIG. 1 schematically shows the electrode arrangement of the self shift type gas discharge panel for multi-row display with the meander electrode structure.
Figure 3A:
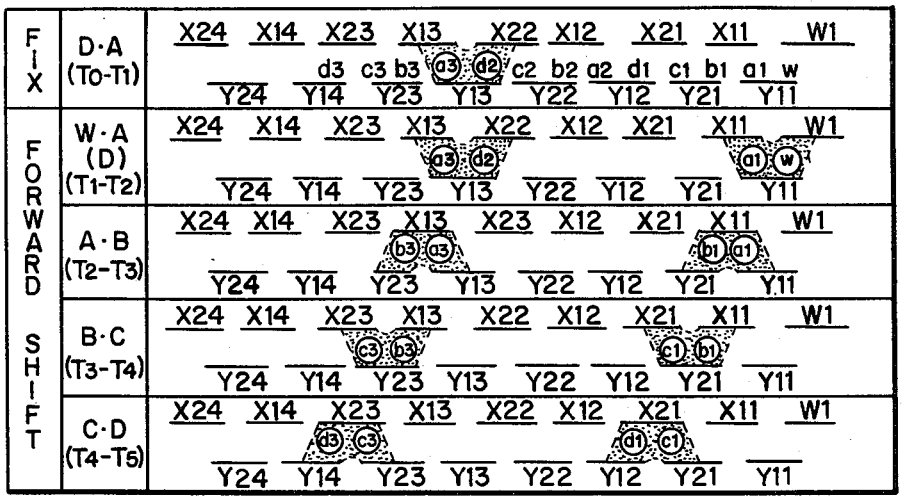
FIG. 3A. PRIOR ART
FIGS. 3(A) and (B) schematically show the write and shift modes at the selected display rows and at the non-selected display rows from the voltage waveforms shown in FIGS. 2(B) and (D).
Figure 3B:
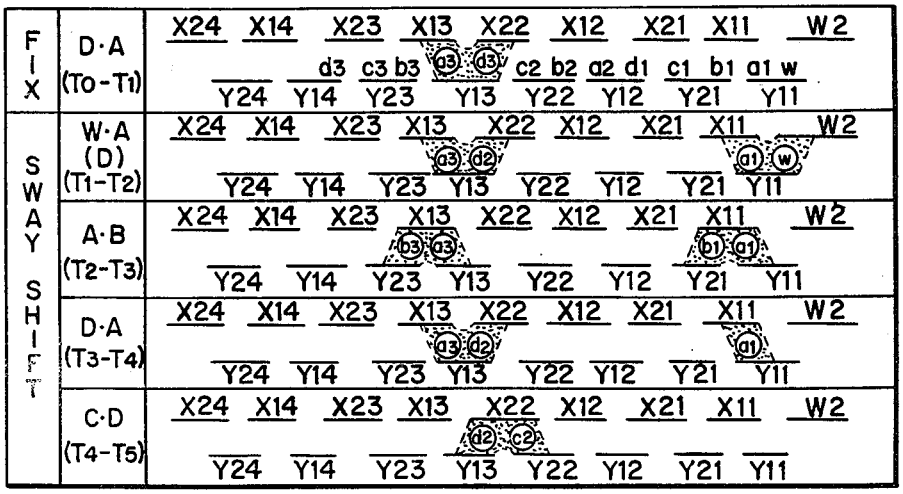
FIG. 3B. PRIOR ART
Figure 2A:
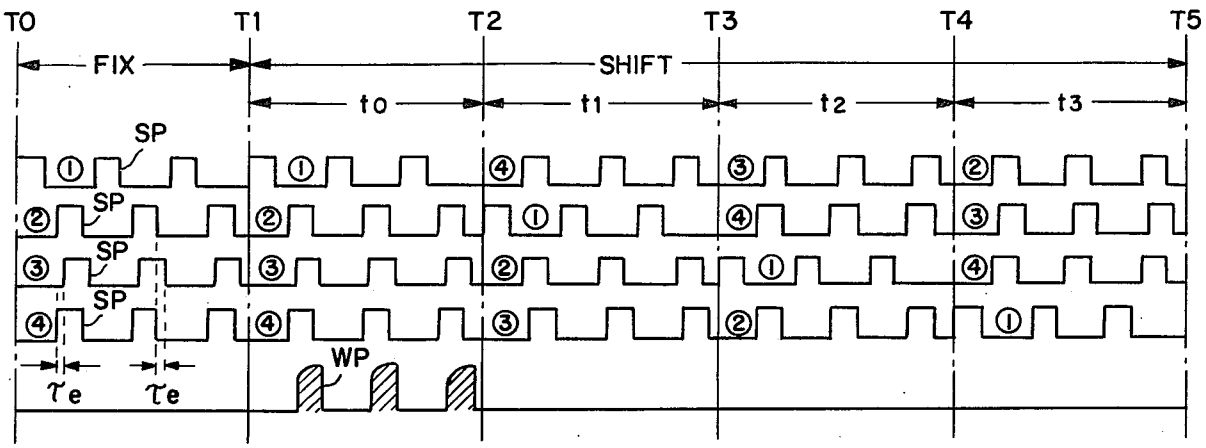
FIG. 2A. PRIOR ART
FIGS. 2(A) to (D) show an example of the driving voltage waveforms for explaining the operation of the panel shown in FIG. 1.
Figure 2B:
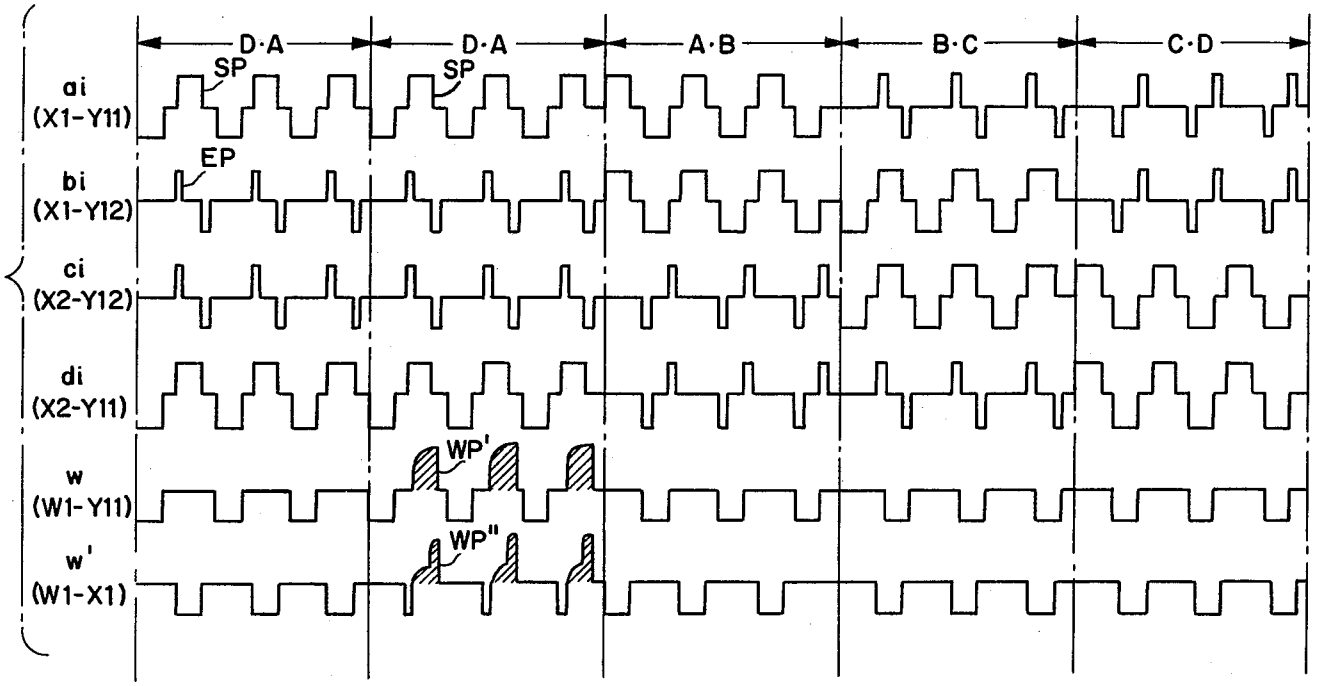
FIG. 2B. PRIOR ART
Figure 2C:
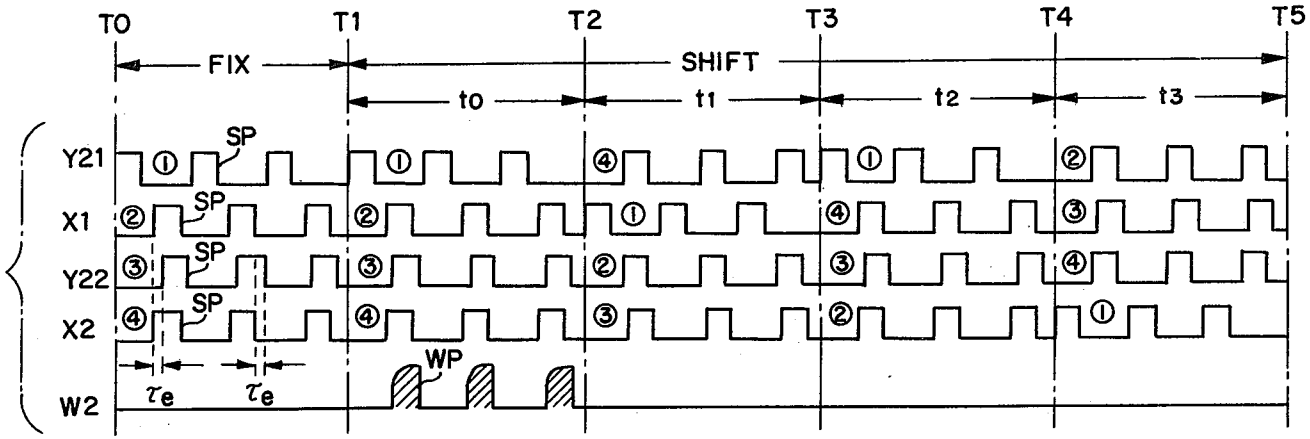
FIG. 2C. PRIOR ART
Figure 2D:
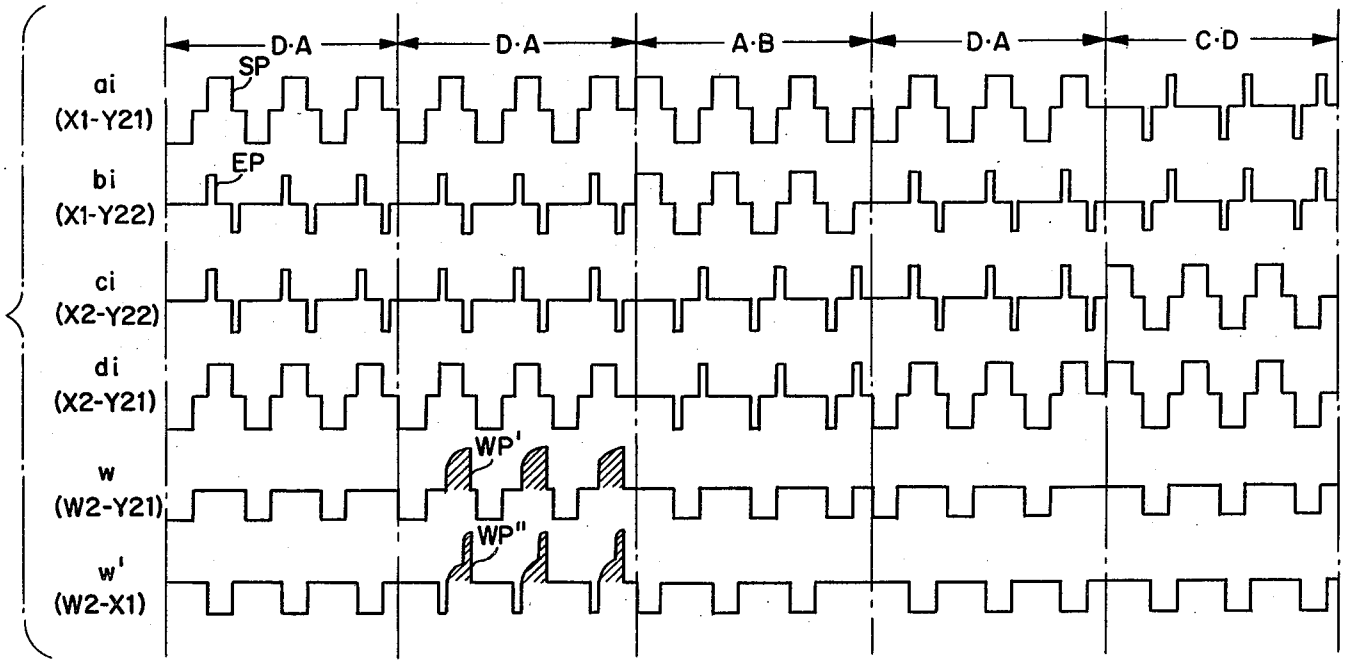
FIG. 2D. PRIOR ART
Figure 4A:
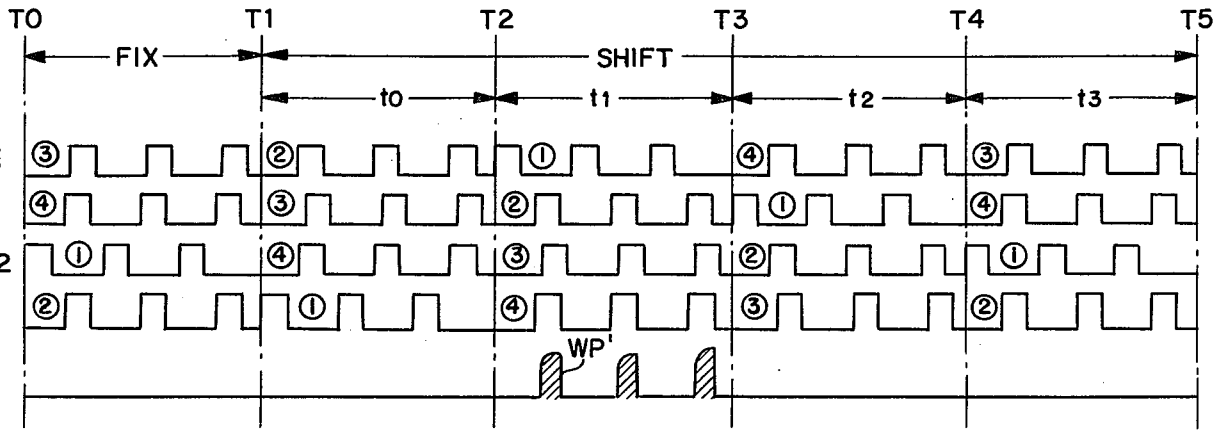
FIGS. 4(A) to (D) show an example of the driving voltage waveforms for explaining the driving system of the present invention.
Figure 4B:
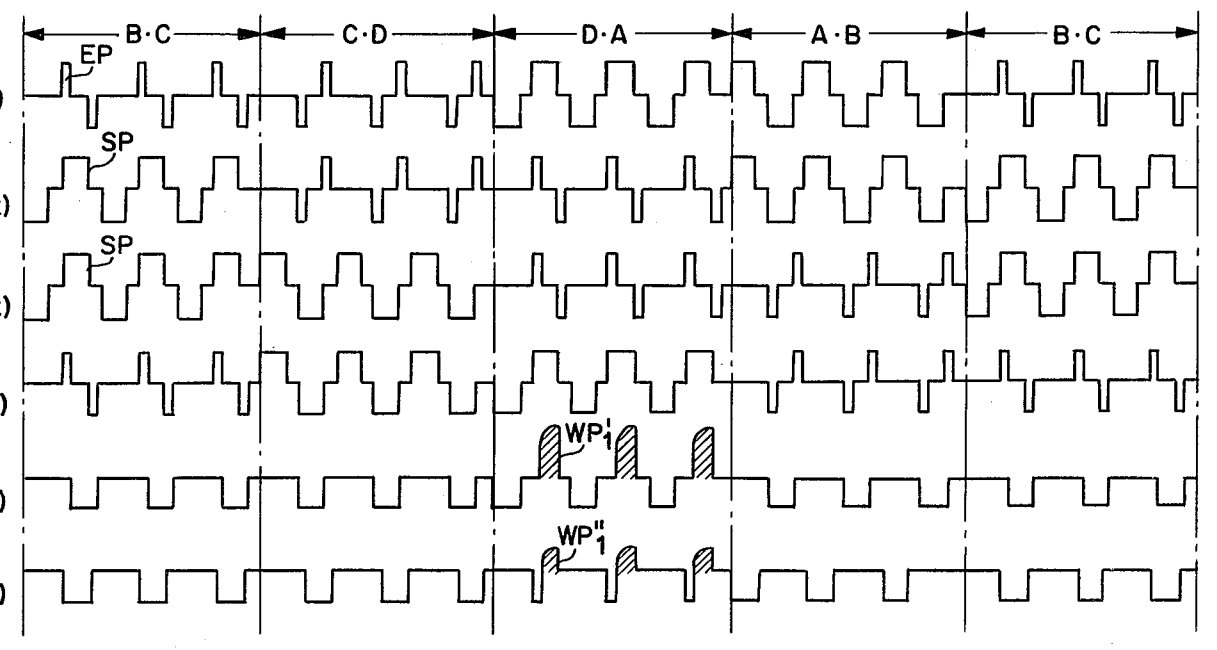
Figure 4C:
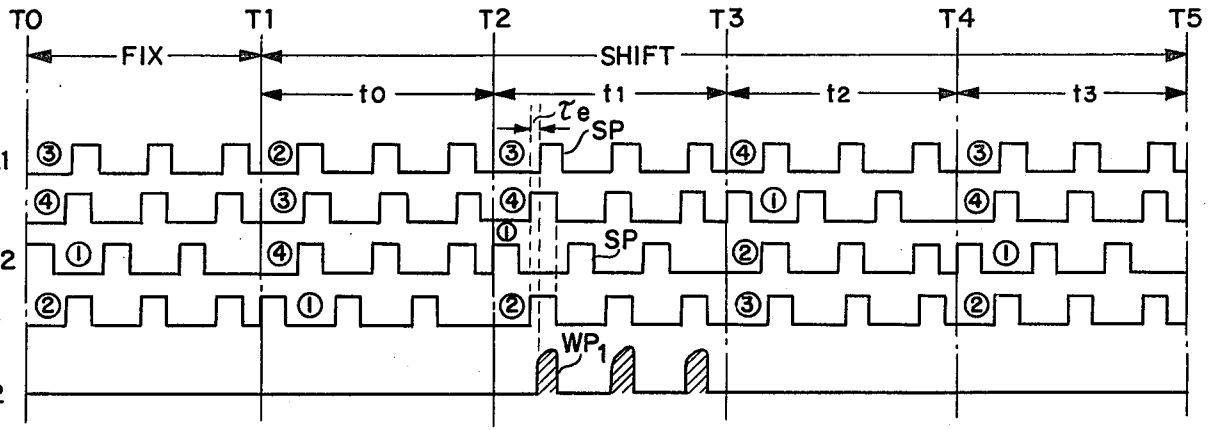
Figure 4D:
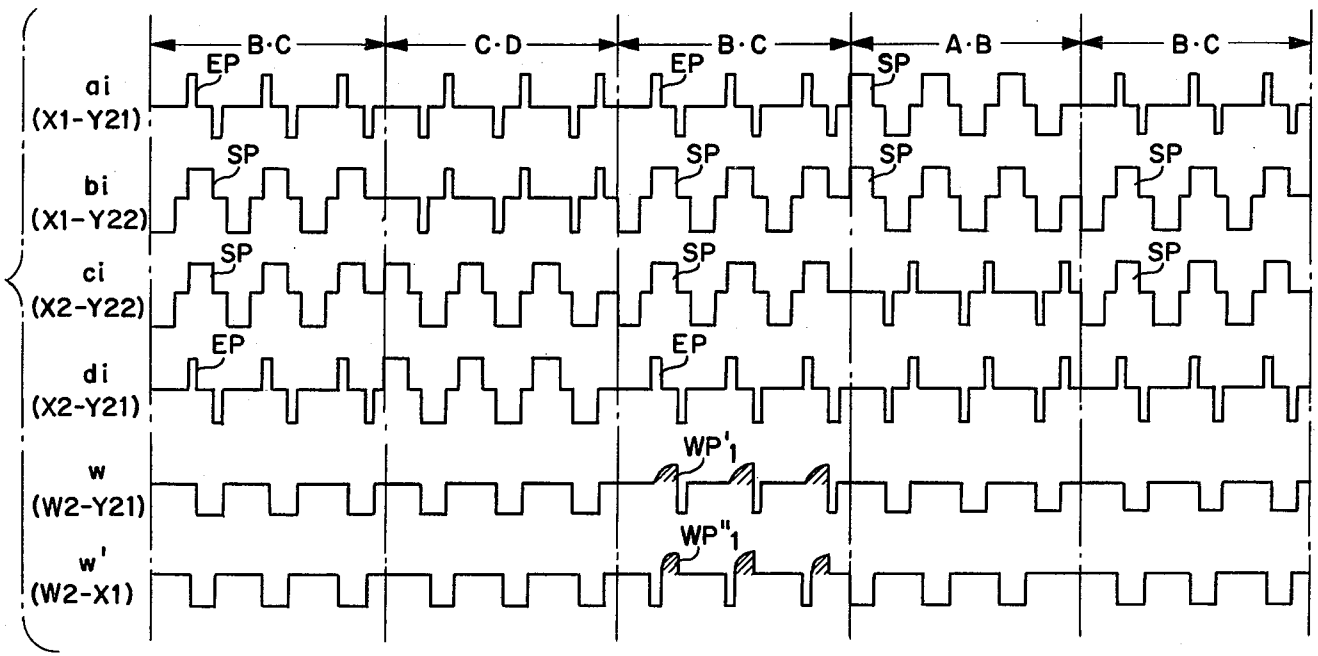

Here, the non-selected display row SC2 is so configurated that the cells are sequentially activated by the way operation in the order of the cell groups ci and di of phases C and D, cell groups bi and ci of phases B and C, cell groups ai and bi of phases A and B and cell groups bi and ci of the phases B and C, and moreover in said write operation, the shift voltage pulses SP as shown in FIG. 4(C) are applied to the Y side buses Y21 and Y22 of the non-selected rows. Therefore, the discharge spot is not generated in this non-selected row SC2. Namely, the shift voltage pulse SP which is in the same phase as the write pulse $WP_1$ to be applied to the write electrode $W_2$ is applied to the bus Y21 and thereby since a low level write voltage waveform $WP_1'$ as shown in FIG. 4(D) is applied to the write cell w defined by the shift electrode $y_{11}$ and write electrode $W_2$ connected to said bus, the write discharge spot is not generated. In addition, since this shift pulse has a phase difference of $\tau_e$ with respect to the shift pulse SP to be applied to the X side buses X1, X2, when the erase voltage pulse EP as shown in FIG. 4(D) is applied to the shift cell groups di and ai of phases D and A defined by the intersecting points of the shift electrodes y1i and x1i, x2i connected to these buses, a discharge spot is not generated at these shift cell groups.

Since said write voltage pulse $WP_1$ is kept narrower than the write voltage pulse WP shown in FIG. 2 and has the waveform that the falling edge matches the falling edge of the shift voltage pulse SP applied to said shift electrode group x1i, only a low level write voltage waveform $WP_1''$ as shown in w' of FIGS. 4(B) and (D) is applied to the surface discharge write area w' defined by the extreme right shift electrode x11 and the write electrode W2, and as a result, the discharge spot is not generated as in the case of said write cell w. Thus, in this period, an erroneous discharge, namely the so-called over-write, is not generated at the shift cell d1 which is in the same phase as the write cell w and is adjacent (or closest) to it that is, being separated by one period of the display, because the write discharge is not generated in the non-selected display row SC2.

On the other hand, since the shift pulse SP having a phase difference of a half period with respect to the voltage waveform applied to said write electrode W2 and X side buses X1, X2 is applied to said bus Y22, the AC shift pulses SP as shown in FIG. 4(D) are applied to the shift cell groups bi, ci of phases B and C determined by the intersection points of the shift electrodes y2i and x1i, x2i connected to these buses. As a result, the shift discharge cells c2 and d2 written prior to the write operation at the non-selected row SC2 are reversely shifted to the shift discharge cells b2 and c2 by this shift pulse train.

In short, when the shift cell groups bi, ci of the phases B and C are selected for discharge during the static display operation, these shift cell groups bi and ci, of phase different from that of shift cell groups di and ai activated in the selected row, are activated in the non-selected display rows on the occasion of giving the write operation to the selected display rows. The shift voltage pulses SP in this condition are in the phase relation as essentially cancel the write voltage pulse $WP_1$ supplied to the write electrode, resulting in the advantage that the write discharge at the non-selected rows can be suppressed without any particular control and there is no fear of causing an adverse influence on the ordinary shift operation.

Figure 5B:
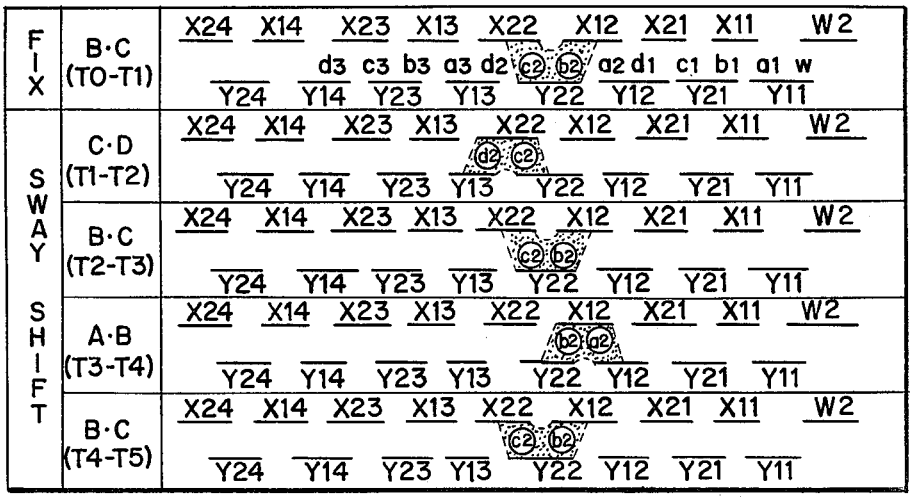

Thus, the discharge spots generated at said shift cells b2 and c2 are sway-shifted in adjacent pairs of discharge cells in the sequence of a2·b2→b2·c2—as a result of the shift pulse SP as shown in FIG. 4(C) being applied to the buses X1, X2, Y21, Y22 in the next steps $t_2$, $t_3$—and the cell voltage waveform as shown in FIG. 4(D) are applied to the shift cell groups ai to di. FIG. 5(B) schematically shows the sway shift operation of discharge spots in the relevant non-selected display row SC2.

Figure 6A:
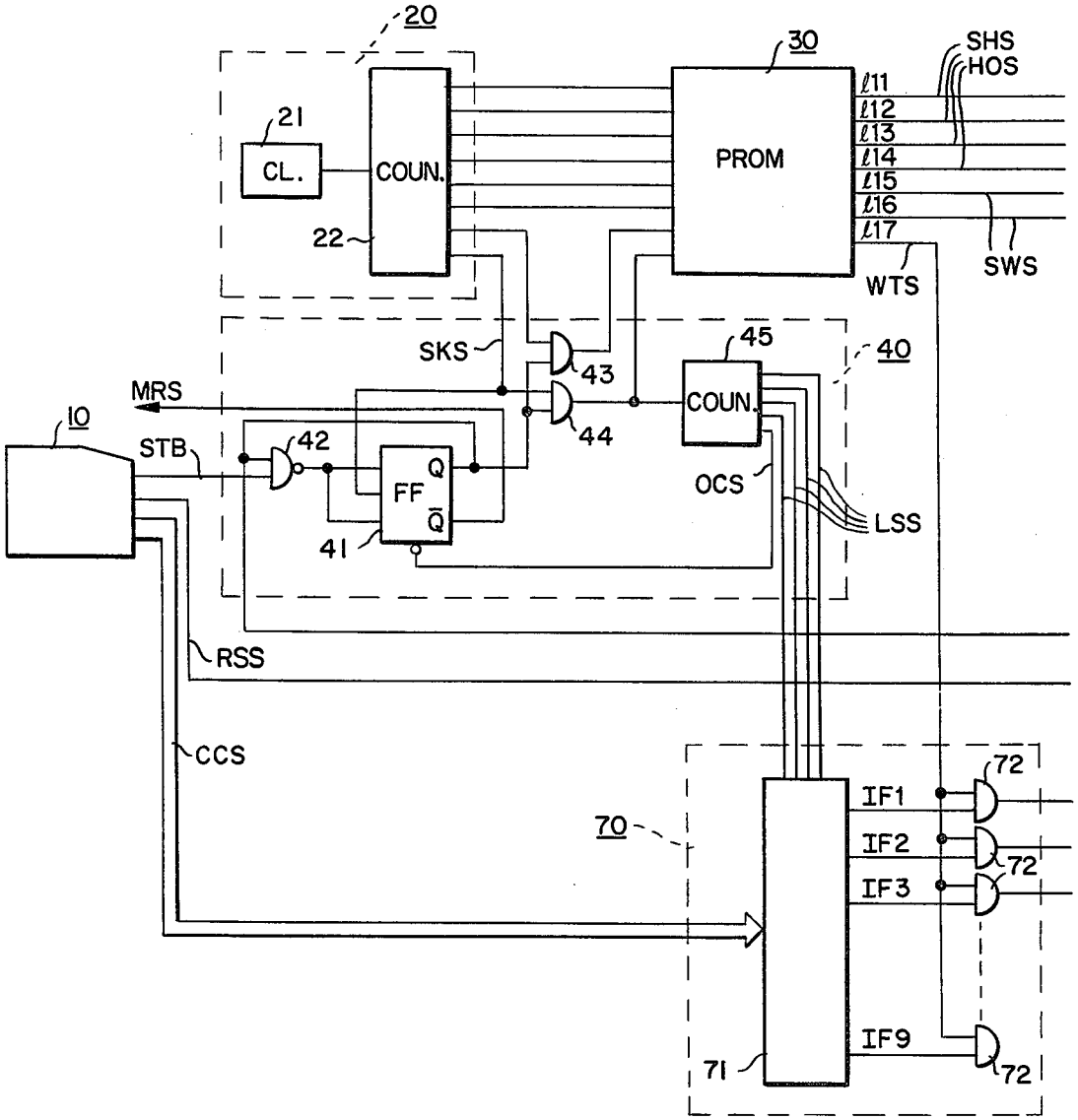
FIGS. 6(A) and (B) show an embodiment of the driving circuit conforming to the present invention.

FIGS. 6(A) and (B) show a system for a character display device wherein the abovementioned embodiment is employed. In this case, the self shift panel PDP is shown having eight display rows ROW1 to ROW8, each of which allows display of 32 characters in total. A character phont is of the 7×9 dot structure, so that each display row is composed of nine shift channels provided in parallel. The display device includes the keyboard 10, counter circuit unit 20, timing signal generator unit 30, control signal generating circuit unit 40, row selection circuit unit 50, shift driving circuit unit 60, write signal generating circuit unit 70 and write driving circuit unit 80.

Said keyboard 10 respectively generates the character code signal CCS corresponding to character information and write command signal STB in response to the character key operations by an operator and also generates the row selection signal RSS by the carriage return key operation. The counter circuit unit 20, mainly composed of the 8-bit counter 22 which counts the pulses sent from the clock pulse generator 21, inputs the lower 6-bit output to the timing signal generating circuit unit 30 and the upper 2-bit output to the control signal generating circuit unit 40, respectively. Since the 8-bit output corresponds to one cycle of the shift operation, it is called therefore the shift clock signal SKS.

Said timing signal generating circuit unit 30 is composed of a programmable read-only-memory (PROM) which generates the timing signals HOS, SHS, SWS for each one step of the abovementioned cycles of static display operation, shift operation and sway shift operation and also generates the write timing signal WTS for write operation. More specifically said PROM has seven memory areas and the 1st and 2nd memory areas store the timing signal which control generation of the basic pulse trains 1 to 4 to be supplied to the X side buses X1 and X2 used in common for each row. The 3rd and 4th memory areas store the timing signals which control generation of the basic pulse trains ① to ④, only for the static display operation, that are and shift operation supplied to the independent Y side buses Yi1 and Yi2 of each row. Moreover, the 5th and 6th memory areas store the timing signals which control generation of the basic pulse trains ① to ④, used only for the sway shift operation, to said Y side buses, while the remaining 7th memory area stores the timing signal which controls generation of the write voltage pulses. These seven timing signals are led in parallel from the corresponding seven output leads $1_{11}$ to $1_{17}$. Said memory areas have a 256 byte structure.

The control signal generating circuit unit 40 comprises the flip-flop curcuit (FF circuit) 41, NAND gate 42, AND gates 43, 44 and noverary counter 45 (which counts to nine for each output). When the strobe signal STB is at logic value "0", namely when character information is keyed in, the Q output of said FF circuit 41 becomes "1", being synchronized with said shift clock signal SKS, thus opening two AND gates 43, 44. Thereby, since all outputs of said 8-bit counter 22 are applied to said PROM 30, the timing signals SHS, SWS and WTS for the shift operation, sway shift operation and write operation of one character are sequentially read in parallel from all memory areas of said PROM. When said stobe signal STB becomes "1", the Q output of FF circuit 41 becomes "0". As a result, the upper 2 bit output of said counter 22 is rejected by the AND gates 43, 44 and the timing signal HOS for static display operation is read repeatedly from the 1st to 4th memory areas in the PROM 30 by the lower 6-bit output. The $\overline{Q}$ output of FF circuit 41 becomes the signal MRS for allowing the writing of character input when it is "1". The novenary counter 45 sequentially counts said shift clock signal SKS and outputs the counter output as the line scan signal LSS for leading the character pattern signal in the form of a binary signal, while also outputting the signal OCS which indicates the end of the shift operation of one character including the inter-character space each time nine shift clock signals SKS are input. The signal OCS is input to said FF circuit 41 and used for resetting the output condition.

The row selection circuit unit 50 is indicated as having the function of selecting rows from a total of eight rows in the case of the illustrated system, and comprises four AND gates 51 to 54, decoder 55 and the pulse train distribution control circuit 56. The AND gates 51 to 54 are provided for controlling the 4-digit binary code indicating whether the row specification signal RSS is to pass or not by the Q output of said FF circuit 41. The decoder 55 decodes said binary code and generates the display row selection signal, being provided with the 8-line output terminals corresponding to the 8-display rows ROW 1 to ROW 8. The pulse train distribution control circuit 56 applies respectively, in accordance with said row selection signal, the basic pulse trains in the distribution sequence, for the shift operation to the shift drivers of selected display rows, while applying the basic pulse trains in the distribution sequence, for the sway shift operation to the shift drivers of non-selected display rows. In more detail, said pulse train distribution control circuit 56 provides two inverters 561, 562 for supplying the basic pulse train to the buses X1, X2 of two phases of X side and eight switch gate circuits 563 to 570 for supplying selectively the basic pulse trains for shift operation and sway shift operation to the 16 buses (eight pairs) Yi1, Yi2 of the two phases of the Y side electrode groups for the display rows ROW1 to ROW8. As indicated in regard to switch gate circuit 570, these switch gate circuits comprise two pairs of AND gates 5701-5702, 5703-5704, NOR gates 5705, 5706 receiving the outputs of four signal lines $l_{13}$ to $l_{16}$ of said PROM 30 and the inverter 5707, in view of switching in accordance with said row selection signal the shift timing signal SHS and the sway shift timing signal SWS for the Y side buses of the display rows.

When said row selection signal is input corresponding to the selected rows, the AND gates 5701 and 5703 operate, for respectively connecting the signal lines $l_{13}$–$l_{37}$ and $l_{14}$–$l_{38}$ for realizing the shift operation in the selected rows. However, if said row selection signal is not input corresponding to the non-selected rows, the AND gates 5702 and 5704 operate, for connecting the signal lines $l_{15}$–$l_{37}$ and $l_{15}$–$l_{38}$ for realizing the sway shift operation in the non-selected rows. When said row specification signal RSS is set to "0" and the row selection signal generation is suspended, all the switch gate circuits 563 to 570 are connected to the signal lines $l_{13}$, $l_{14}$ of said PROM and thereby said static display operation is carried out.

On the other hand, the shift driving circuit unit 60 provides 18 drivers (not illustrated) connected respectively to the two buses X1, X2 in the X side of said PDP and to the 16 Y side buses (eight pairs) Yi1, Yi2, and these drivers respectively output the shift voltage pulses SP when said timing signals for static display, shift and sway shift operations (involving four basic pulse trains ① to ④ ) HOS, SHS and SWS are received. In addition, the write signal generating circuit unit 70 is composed of the character generator 71 which sequentially outputs the character pattern signals of 7×9 dots $IF_1$ to $IF_9$ corresponding to said character code signal CCS sent from keyboard 10 in seven bits for nine lines in accordance with said line scan signal LSS and the AND gate group 72 which controls these pattern signal outputs to pass them or not in accordance with said write timing signal WTS. The write driving circuit unit 80 provides nine drivers each of which generates the write voltage pulse $WP_1$ with an input of said character pattern signals $IF_1$ to $IF_9$ and outputs these pulses selectively in common to the nine write electrodes of each of the eight display rows ROW1 to ROW8 of said PDP.

Explained above is an embodiment of the present invention, but the essential features of the present invention are not limited only to such an embodiment and allow a variety of modifications and extensions.

Figure 7A:
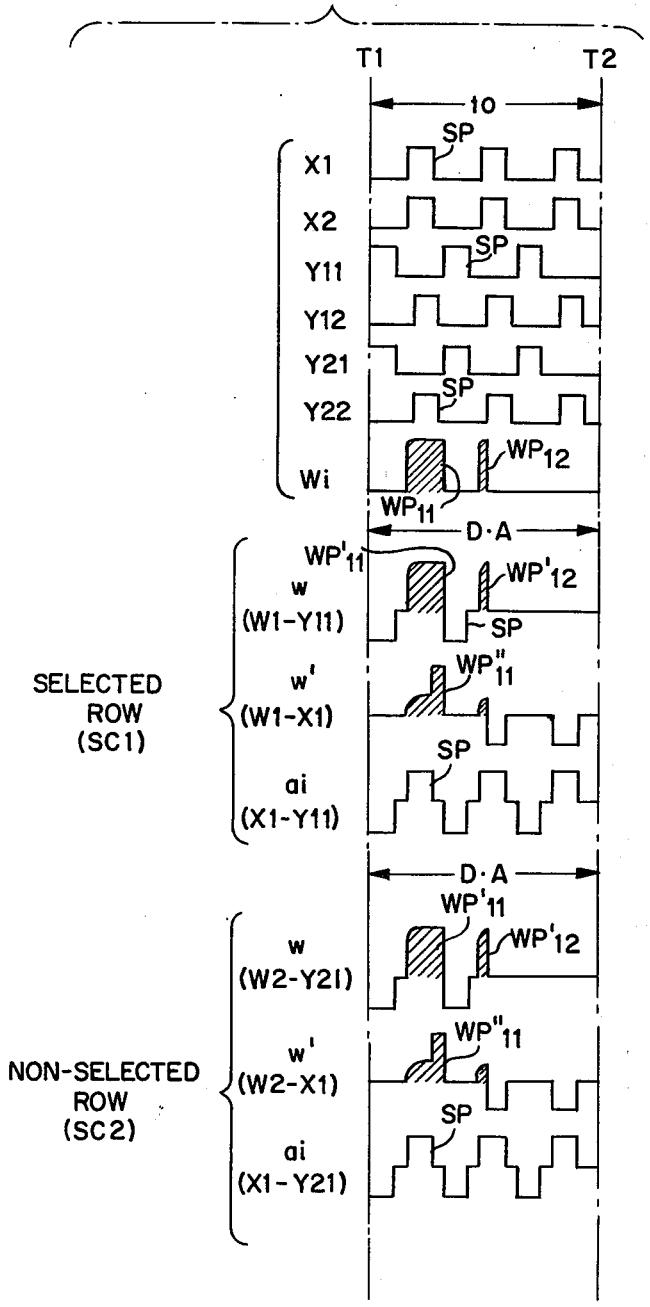
FIG. 7A. PRIOR ART
FIGS. 7(A) and (B) show driving voltage waveforms indicating a modification of the present invention.
Figure 7B:
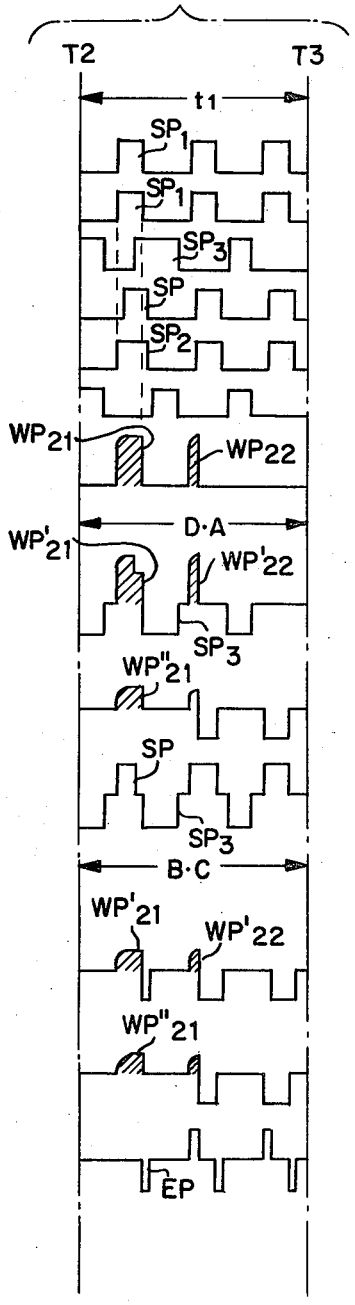

As an example of a modification, application to a conventional driving system is proposed, wherein the write operation is executed by means of a pulse combining a wide write pulse and a narrow write pulse. FIG. 7(A) shows the driving voltage waveforms for explaining such a conventional write operation, while FIG. 7(B) shows the driving voltage waveform for explaining the write operation of the present invention, respectively. The drawings indicate the cell voltage waveforms of the selected row SC1 and non-selected row SC2, including those of the write cells w, surface discharge write areas w' and the shift cell groups ai of phase A. When making reference to the conventional driving voltage waveforms shown in FIG. 7(A), two write pulses $WP_{11}$ and $WP_{12}$ based on the write information are sequentially applied to the write electrodes of a display row in the first step $t_0$ of one shift cycle. Thereby, the write voltage waveforms indicated as w and w' are applied to the write cell w and surface discharge display area w' of the display rows. In more detail, the first write pulse $WP_{11}$ which is wider (about 12 μsec) and higher in level than the shift pulse PS, is applied directly as $WP'_{11}$ to the write cell w, and as the partly cancelled narrow pulse $WP''_{11}$ to the surface discharge write area w'. As a result, the write discharge spots are generated respectively at these write positions and simultaneously the discharge spots are also generated at the adjacent first shift cell a1. At the non-selected row SC2, an erroneous discharge occurs at the shift cell d1 in the same phase as the write cell w due to the above-mentioned reason. The discharge spots generated at said write cell w are sustained by the shift pulse SP and the narrow (1 to 2 μsec) write pulse $WP'_{12}$ applied succeedingly to the first shift electrode $y_{11}$ opposite to the write electrodes $W_1$ and $W_2$, but in the case of the latter write pulse $WP'_{12}$, it cannot accumulate the wall charges which will help the discharge operation at the dielectric layer surface corresponding to said write discharge cells because it has a narrow discharge time and corresponds to the so-called discharge for erasing. Therefore, the discharge is not generated by the shift voltage pulse SP applied in succession and thereby the erroneous write discharges can be prevented. Here, the falling edge of the wide write pulses $WP'_{11}$ and $WP''_{11}$ are matched with the rising edge of the next pulse SP because it is necessary to prevent the discharge once generated at the write cell w from being self-erased at this timing.

Then, according to the driving waveforms of the present invention shown in FIG. 7(B), two write pulses $WP_{21}$, $WP_{22}$ are sequentially applied at the 2nd step $t_1$ of one shift cycle. As is apparent from this figure, the falling edge of the first, wide write pulse $WP_{21}$ is matched with the falling edge of the shift pulse $SP_1$ applied to the buses X1, X2 in the X side by quickening the rising time. In addition, the rising edge of the shift pulse $SP_2$ applied to the bus Y21 in the Y side of the non-selected row SC2 is matched with the rising edge of said write pulse $WP_{21}$ by quickening the rising time. Namely, said write pulse $WP_{21}$ and said shift pulses $SP_1$, $SP_2$ are set in the same phase and same pulse width. In this case, the shift cells of the phases D and A are activated at the selected rows, while the shift cells of phases B and C are activated at the non-selected rows. The cell voltage waveforms of write cell w and surface discharge write area w' obtained by combining such modified pulses are formed as the ordinary write voltage waveform $WP'_{21}$ at the write cell of a selected display row SC1 as shown by w, w' of FIG. 7(B), but they form the low amplitude voltage waveforms $WP'_{21}$, $WP''_{21}$ at the write cell and surface discharge write area of the non-selected display row SC2, thus not contributing to the write operation. For this reason, the over-write at the non-selected display rows can be prevented also by these driving waveforms as in the case of the waveforms shown in FIGS. 4(A) to (D). In regard to the selected row SC1, when the rising edge of the shift pulse $SP_3$ applied to the bus Y11 in the Y side is overlapped with the write pulse $WP_{21}$ by advancing the rising time, the write voltage indicated as $WP'_{21}$ is applied to the relevant write cell w, and as a result, the self erase of a write discharge can be prevented also as in the case of the write voltage $WP'_{11}$ shown in FIG. 7(A).

An example of an extension of the present invention is now explained. The present invention can be applied to panels as explained previously such as the panel having the meander type shift channel described in the specification of U.S. Pat. No. 4,185,229, in addition to the self shift type gas discharge panel of the meander electrode type. Moreover, the present invention can also be applied to the panel comprising the electrode structure wherein the number of electrode groups is increased to more than 2-groups×2-groups, and to those providing a parallel electrode structure, a matrix electrode structure or a monolithic structure as described in the specification of U.S. Pat. No. 3,944,875.

It is most desirable for preventing write discharge at the non-selected rows to apply the present invention to the write cell and surface discharge write area as explained in the preceding embodiment, but since the discharge at the surface discharge write area is similar to the discharge in a short period, that is, the so-called erase discharge as is apparent from the write waveform applied thereto, the probability of individual erroneous discharge is comparatively low. Therefore, a sufficient effect can be obtained only by preventing the discharges at the write cells.

Moreover, according to further examples of extension of the present invention, a driving system for preventing abnormal discharge and over-write occurring accidentally to the selected display rows is proposed. Namely, the self shift type gas discharge panel has a peculiar disadvantage that an accidental abnormal discharge not based on information occurs at both ends of the shift channel as the shift operation is repeated. As explained above, it is already proved that such abnormal discharges result from unequal distribution of wall charges accumulated at both ends of said shift channel. Namely, the electrons are excessively accumulated at the cells in the information reading side, while ions accumulate in the cells at the terminating side. Thus, the relevant cells erroneously fire by means of the shift voltage, although they cannot fire by themselves, because such abnormal wall charge lowers the firing voltage of corresponding cells below the ordinary firing voltage. The total write sequence for eliminating such erroneous discharge is also already proposed. This total write sequence is outlined below briefly. Prior to operation for generating discharge spots to be displayed corresponding to input information, all discharge cells of the shift channels are lit at one time, and then the erase operation is performed in order to neutralize said abnormal wall charges under the condition that all cells are lit. Thus, an erroneous discharge can be prevented.

However, in such a total write sequence, the discharge spots while all cells are lit cause "flickering", resulting in a problem during operation in that operator fatigue is increased. Thus, various experiments were conducted for investigating the interrelation between this reduction in the erroneous discharge generation and the visual influence, and it was confirmed that the optimum total ignite period mentioned above is 0.4 msec. But such a total ignite period brings about a new problem that the above-mentioned over-write occurs on the occasion of writing the first information. The over-write phenomenon in such a case will be explained in more detail. According to said total ignite period and the succeeding all cell erasing operation, said abnormal wall charges are not perfectly erased (neutralized). Moreover, the unipolar shift voltage pulse (discharge sustaining voltage pulse) is continuously applied to the write discharge cells in the write drive waveform. Then, such a shift voltage pulse causes the discharge once at the relevant write cell by means of the priming effect due to the discharge at the adjacent shift discharge cells, thus accumulating the wall charges. Such wall charges are of the same polarity as the write voltage pulse based on an input information, which is the reverse polarity of said shift voltage pulse applied succeedingly. The above remaining wall charge and the newly accumulated wall charge are insufficient for generating erroneous discharge by the voltage level of the shift voltage pulse during the shift operation. However, the write voltage pulse during the write operation is higher than said shift voltage in its voltage level and allows superimposition of said accumulated wall charge thereon. Thus, a high voltage is applied to the write cell and an intensified discharge occurs. The priming effect due to this write discharge is effectively given to the adjacent shift cells, further lowering the firing voltage of the relevant cells. Therefore, the shift cell which is the same in phase as said write cell and is adjacent thereto generates an unwanted erroneous discharge, namely the so-called over-write occurs simultaneously with said write discharge due to the lowered firing voltage resulting from the multiplied effect of said remaining wall charge and said priming effect.

For instance, when the total ignite period is expanded to longer than 1 msec, it was observed that such over-write does not occur. This is because said accumulated wall charge is neutralized and stabilized by means of a large amount of space charge due to the discharge for a long period of time.

FIG. 8 shows the operating margin characteristic where the total ignite period is plotted on the horizontal axis, with the upper limit level of the write voltage on the vertical axis and the shift voltage changed as the parameter. This shows that the upper limit level of the write voltage changes depending on the total write period. In the same figure, it is understood that since the lower limit level ($V_{Wmin}$) of the write voltage is about 100 to 110 V for the illustrated curves, the write operating margin determined by the difference from the upper limit level ($V_{Wmax}$) becomes a minimum for the case when the total write period is 0.4 msec, indicating that the over-write is likely to occur. Moreover, it can also be understood that when the total ignite operation is not carried out, the shift operating margin (determined by the difference between the upper level ($V_{Smax}$) and the lower level ($V_{Smin}$) of the shift voltage) is small and an accidental or abnormal discharge occurs easily, but that the write operating margin is large and the over-write can be eliminated by proper selection of the ignite period.

Thus, with the above-mentioned background, the present invention proposes the following driving system in view of preventing the over-write in such a driving condition that "flickering" and accidental abnormal discharge are successfully eliminated. Briefly, this newly proposed driving system involves the total write sequence which is applied to a selected single display row or to all display rows, including after the total erase operation the added operation that the write cells are lit by artificial write information under the condition that the shift channel is operated in the backward shift operation mode. In summary, this invention is intended to clear the dielectric layer surface in the vicinity of the relevant write cells by intentionally generating the over-write phenomenon before the specified write operation and by then exhausting such erroneous discharge information to the side of write cell.

Figure 9A:
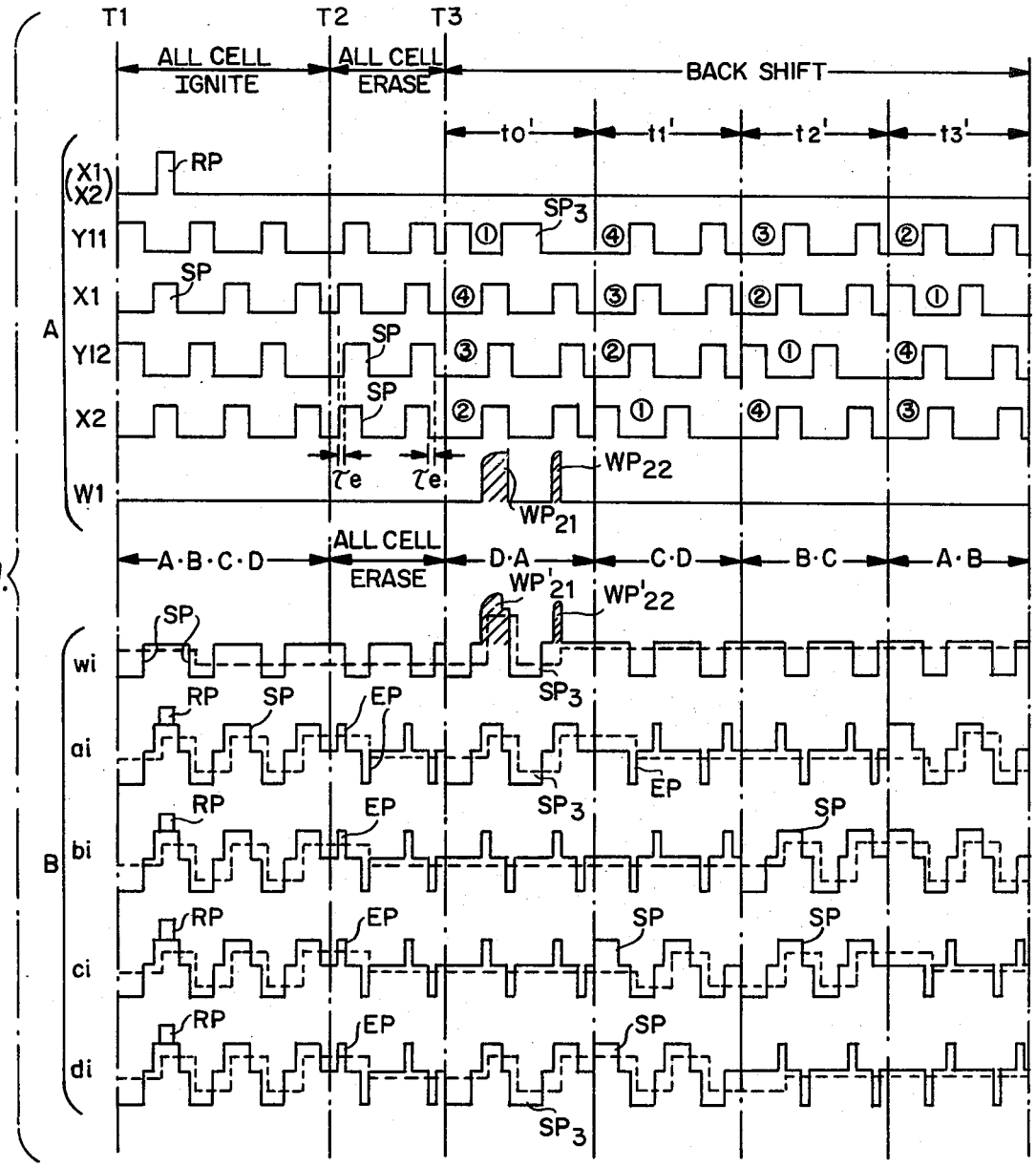
FIGS. 9(A) and (B), show shows the driving voltage waveforms conforming to another embodiment of the present invention.

FIGS. 9(A) and (B) show the driving voltage waveforms for solving the abovementioned problems. As in the case of the preceding embodiment, the waveforms of the 1st display row SC1 are typically indicated under the supposition that the relevant row is selected. In FIG. 9(A), when referring to the period $T_1$–$T_2$ within the periods $T_1$–$T_4$ relating to the total write sequence, while the buses Y11, Y12 in the Y side of the selected row SC1 are at ground potential, the ignite voltage pulse RP having a potential exceeding the discharge start voltage is respectively applied to the buses X1 and X2 mentioned above at the timing that the shift voltage pulse SP is applied to the buses X1, X2 of the X side common to the display rows. Thereby the voltages indicated for the cells ai to di in FIG. 9(A) are applied to the shift cell groups ai to di of all phases (phase A to phase D) of the selected display row SC1 and, as a result, the discharge spots are generated at all of these cell groups. Namely, the ignite operation has been performed on all cells. At this time, since the unipolar shift pulse SP as indicated by wi of FIG. 9(A) is applied to the write discharge cell w, the discharge spots are generated at the relevant write cells when the first pulse of the relevant pulse train is applied, with the help of the priming effect due to the discharge of said shift cells as described above. Since the wall charge due to such discharge is of the same polarity as the next shift pulse, the repeated write discharge does not occur and therefore such wall charge is directly accumulated at the dielectric layer surface on the write cell. On the other hand, when the ignite pulse RP is applied to the selected row SC1, the shift pulse, not illustrated, is applied to the non-selected display row SC2. For this reason, the discharge cells of the relevant non-selected row do not suffer any discharge as a result of cancellation of both pulses.

Following this all cell write operation, when the shift voltage pulse SP is applied to said buses X1 and Y11, X2 and Y12, giving to Y11 and Y12 a phase delay of $\tau_e$, in the period $T_2$–$T_3$, the erase voltage pulse EP is effectively applied to all shift cells. Thereby the erase discharge for erasing said discharge spot appears at the relevant shift cell and, as a result, many abnormal wall charges are erased on the relevant cell. In short, a total cell erasing operation has been conducted. Thereby, an abnormal discharge no longer occurs when the discharge spot is shifted along the shift channel. But, such an erasing discharge cannot erase accumulated wall charge on the dielectric layer surface corresponding to said write cell. Therefore this wall charge mainly causes the over-write due to the intensified write discharge on the occasion of writing an input information as explained previously.

In the case of the present invention, the operation for eliminating accumulated wall charge in the vicinity of the write cell is by writing an artificial information while applying the backward shift in the next period $T_3$–$T_4$. Namely, referring to the step $t'_0$, first, two write voltage pulses $WP_{21}'$, $WP_{22}'$ based on the artificial write information which is generated along with the relevant total write sequence are sequentially applied the write electrode W1 of the selected row SC1, and the write voltage waveform wi is applied to the write cell w. The write operation itself is the same as that of FIGS. 7(A) and (B) explained previously and therefore explanation is omitted. However, the write discharge spot in this case is accompanied by a discharge power larger than the ordinary one because of the remaining wall charge on the aforementioned write cell. Moreover, in this case, the discharge spot is also generated at the first shift cell a1 adjacent to the write cell. Moreover, since the shift pulse SP is applied also to the shift cell $d_1$, an erroneous discharge, namely the over write is generated at the cell $d_1$ by the priming effect of said intensified write discharge in case the remaining wall charge still exists on the dielectric layer surface corresponding to the same cell.

Here, the discharge spot generated at said write discharge cell w is erased by the 2nd write pulse $WP_{22}'$ as explained above, and as a result the dielectric layer surface corresponding to the write cell is cleared. The dotted line curves of wi in FIGS. 9(A) and (B) show the variation of such a wall charge (in terms of the associated wall voltage). During this period, the discharge spots generated at said shift cells a1 and d1 are sustained by the shift pulses, which are respectively applied alternately to pairs of opposing shift electrodes $y_{11}$ and $x_{11}$, $y_{12}$ and $x_{21}$ which determine the relevant cell, and the polarity inversion of the wall voltage is repeated as indicated by the dotted line for the cells ai and di of FIG. 9(A).

In the succeeding step $t'_1$, the erase pulses EP are applied to the shift cell groups ai, bi of the phases A and B, while the shift pulses SP are alternatively applied to the shift cell groups ci, di of the phases C and D respectively as the basic pulse trains are applied to each bus. Thereby, the discharge spots are generated simultaneously at said shift cell d1 and the shift cell c1 adjacent thereto. However, the discharge spot generated at said shift cell a1 is erased when the erase pulses EP are applied at this timing.

Figure 9B:
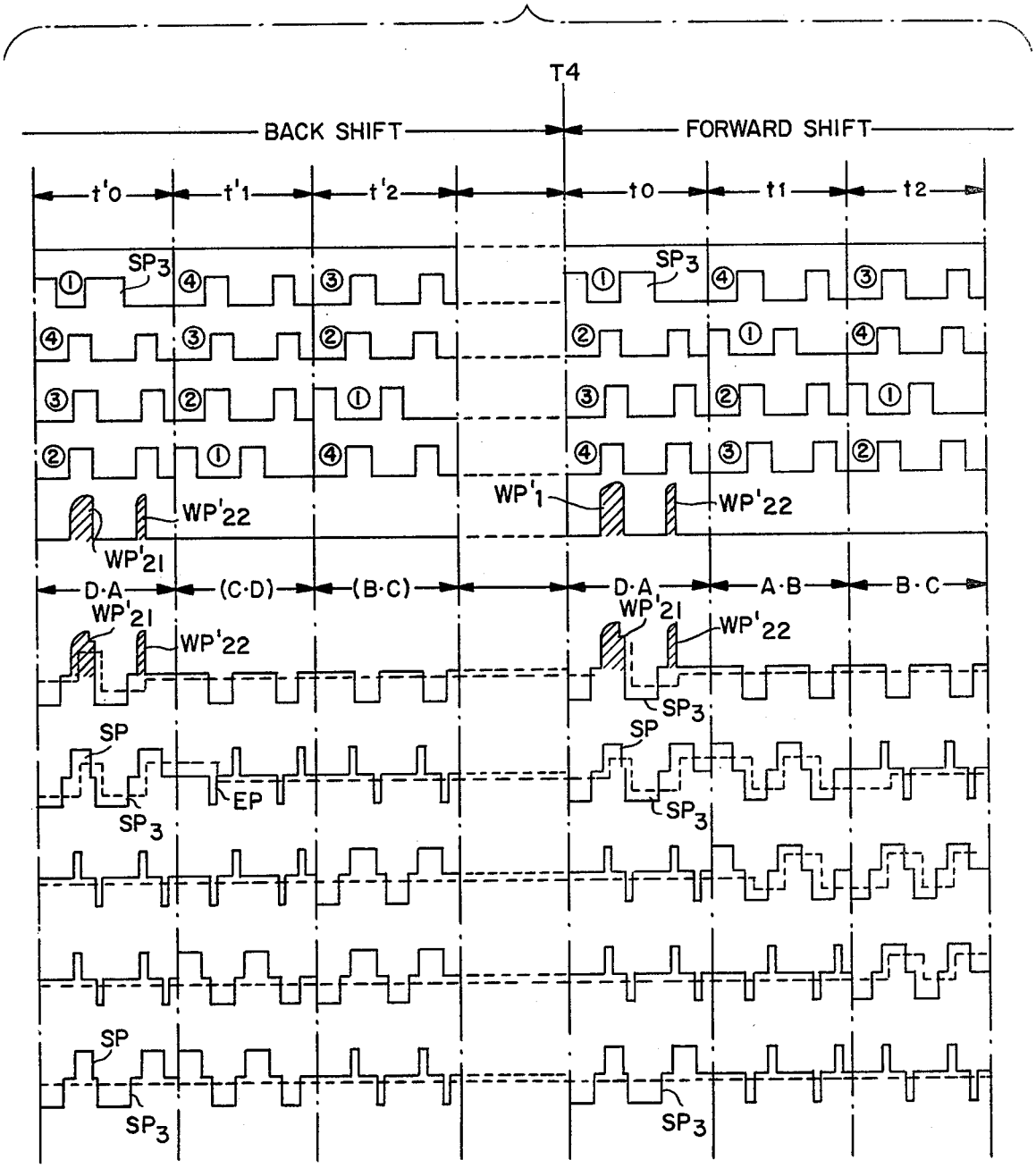

Each discharge spot is sequentially shifted to the side of the write cell w along the selected row SC1 in such a manner as to co-occupy two adjacent discharge cells b1·c1, a1·b1, while the basic pulse train as indicated in the figure are applied in the next steps $t'_2$, $t'_3$. In other words, the backward shift operation is carried out. Here it should be noted that, as is apparent by comparing the driving waveforms shown in FIGS. 4(A) and (B) indicating the forward shift operation, the abovementioned backward shift operation is carried out only by alternately interchanging the basic pulse trains ① to ④ which are to be applied to the buses X1 and X2 of two phases of the X side electrode groups. Thus, one shift cycle, namely the shift operation for one picture element, is carried out in the four steps from $t'_0$ to $t'_3$. When this reverse shift operation is repeated, the discharge spots are exhausted to the end of the write cell and cleared. In the 2nd shift cycle illustrated in FIG. 9(B), the write pulses are not always necessary and can be omitted. FIG. 10 schematically shows the shift mode of the discharge spots in the total write sequence in correspondence to the cell voltage waveforms shown in FIGS. 9(A) and (B).

Such a new total write sequence successfully reduces the amount of abnormally accumulated wall charge at the dielectric layer surface corresponding to all the shift cells to such a degree as to not induce an accidental erroneous discharge, and moreover eliminates (erases) the accumulated wall charge on the write cells.

When such a total write sequence is completed, the write operation for input information is performed as is well known, but in this case, the shift operation is switched to the original forward shift mode. In the cycle after the period $T_4$ of FIG. 9(B), the voltage waveforms for executing the write operation are indicated. This operation is the same as that of FIGS. 4(A) to (D) and FIG. 7(B), so that the explanation is omitted here. In this case, the discharge power of the write discharge spot is normal and not excessive and therefore an erroneous discharge, namely the over-write does not occur at the shift cell $d_1$ located in the vicinity of said write cell w.

Figure 6B:
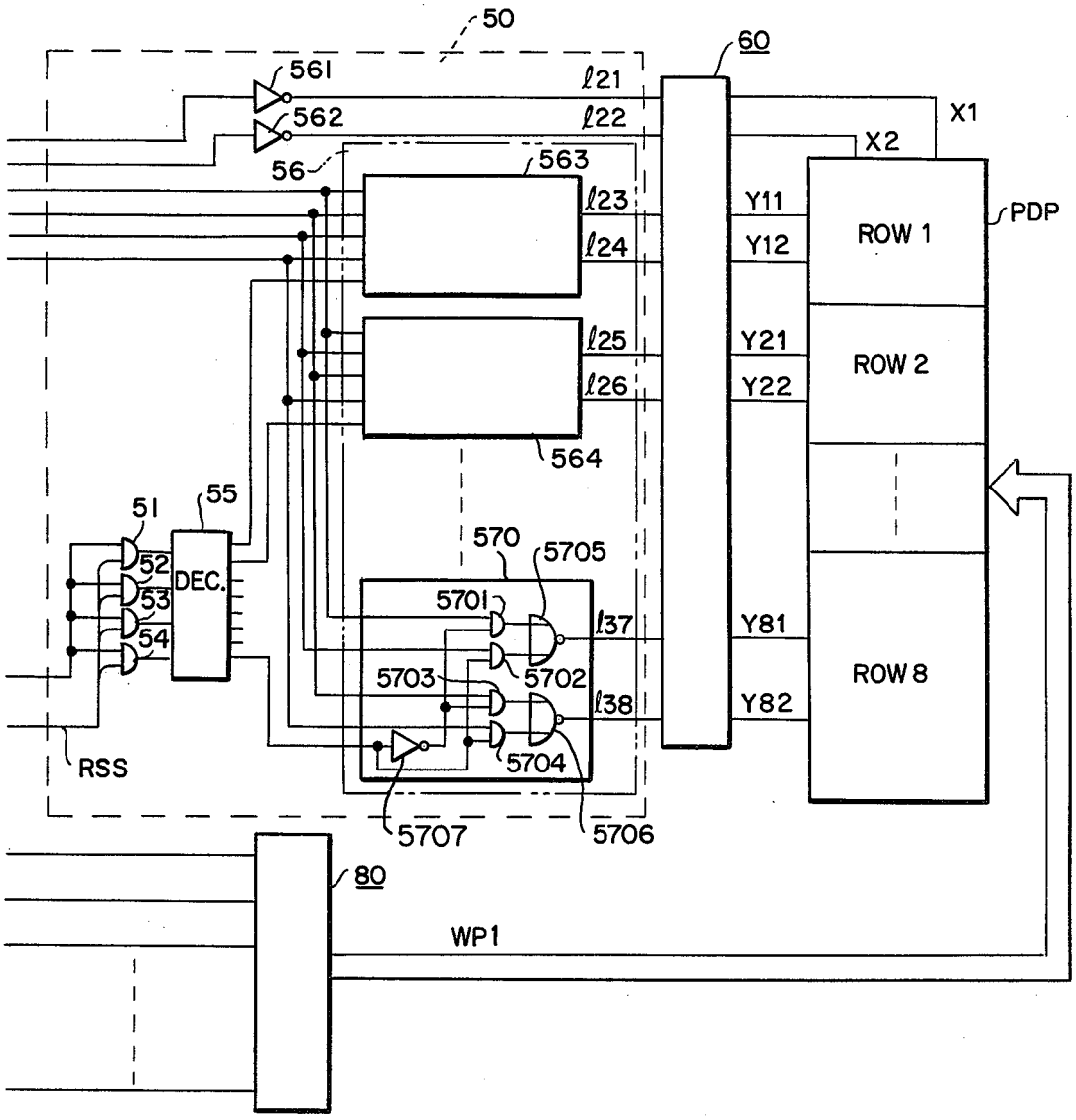

Such a total write sequence can be executed by adding the following structure to the driving circuit shown in FIG. 6. In other words, the basic pulse trains (timing signal) for the abovementioned all cell ignite operation, the all cell erase operation and the backward shift operation are additionally stored in the 1st to 6th memory area of said PROM 30, and the timing signal for controlling the generation of the ignite voltage pulse may be stored in a newly added area of the memory. Moreover, an output of the ignite voltage pulse generating circuit is connected in common to said buses X1 and X2 in the X side and an input to this generating circuit is connected to the timing signal for said ignite timing. The instruction for the total write sequence is issued from the carriage return key of said keyboard 10 and the automatic carriage return circuit. As the artificial write information, a character information can be used which provides the write operation to all write cells of the display rows, such as the character "I".

As will be obvious from the above explanation, the driving system for the self shift type gas discharge panel of the present invention is capable of eliminating said accidental abnormal discharge which is a peculiar disadvantage of such a panel and of thusly preventing an over-write phenomenon, even under the optimum visual condition. More specifically, on the occasion of writing information into the selected display rows particularly in the panel for multi-row display, the overwrite is not generated at all at the selected rows and the remaining non-selected rows. Therefore, a stable and accurate write operation can be realized with a large write operating margin. For this reason, the present invention is very effective for improving the display quality of such display panels.

The present invention is limited only by the scope of the following claims.

We claim:

1. A self shift type gas discharge panel having plural rows for writing and shifting information in the form of discharge spots for display in selected rows, while displaying previously written information in the non-selected rows, said panel comprising each said row including a plurality of shift channels of respective orders arranged in parallel, each said shift channel comprising a periodic arrangement of shift discharge cells formed by a periodic arrangement of plural groups of shift electrodes separated by a discharge space, each said shift discharge cell being defined between opposing portions of respective pairs of said shift electrodes, a first set of said groups of electrodes being defined by each said group thereof including respective shift electrodes of the shift channels of all said rows, and a second set of groups being defined by each group thereof including respective electrodes from all the shift channels of a respective row, each said shift channel having a write electrode with a portion opposing a portion of a respective one of said shift electrodes of a respective one of said groups of said second set, to form a write discharge cell at one end of each said shift channel, all of the write electrodes corresponding to the shift channels of the same order of all of said rows being connected in common, and control means for supplying shift pulses to said groups of electrodes for shifting and displaying said discharge spots in a manner that is consistent with said periodic arrangement of shift discharge cells and so that a periodic sequence of different phases is attributable to said shift discharge cells along each said shift channel, for selectively applying write voltage pulses to the write electrodes, corresponding to information to be written into at least one selected row for display, wherein discharges at the respective write cells in the non-selected shift rows are prevented by applying first voltage pulses, which have the same polarity and at least the same time width as said write voltage pulses, to the respective group of shift electrodes of said second set having said portions opposing the write electrodes in the non-selected shift rows, when applying said write voltage pulses, so that the supply of said write voltage pulses to the write discharge cells of the non-selected rows is effectively cancelled.

2. The panel of claim 1, said control means providing second voltage pulses which have the same polarity and at least the same time width as said write voltage pulses to the shift electrodes which, with the respective shift electrodes of the respective groups of said first set, form the respective discharge cells of the first phase which are adjacent to the write cell of each of said row, when applying said write voltage pulses, so as to prevent discharge between each write electrode and the respective electrode of the respective group of said first set forming said adjacent discharge cell of said first phase.

3. The panel of claim 1, said first voltage pulses being shift voltage pulses for said displaying of previously written information in said non-selected rows by sway-shifting the respective discharge spots within one period of said periodic sequence of discharge cells of different phases, said first voltage pulses having a timing that overlap the falling of said write voltage pulses.

4. The panel of claim 1, 2 or 3, wherein said control means, prior to said selectively applying of said write voltage pulses to said write electrodes, corresponding to information to be written and shifted for display in each respective selected row, temporarily writes a discharge spot at each said write cell of at least each selected shift row by applying at least one further write voltage pulse not corresponding to said information for display to each said write electrode, and thereafter applies predetermined shift voltage pulses to said electrode groups of said second set and to the respective electrode groups of said first set to provide backward shift of at least one period of said periodic sequence in said selected rows, wherein an unwanted erroneous discharge spot at the shift discharge cell of each shift channel of each selected row which is in the same phase as each said write cell and closest thereto disappears.

5. The panel of claim 1, 2 or 3, wherein there are four discharge cells of four different phases in each said period of said periodic sequence and the shifting and displaying of information includes said control means providing shift pulses to said groups of shift electrodes with a repeated period of four steps per period for said shifting and displaying of information, so that discharge spots are written and shifted in the forward direction along the shift channels of each selected shift row, discharge spots are sway-shifted within one period of said periodic arrangement of said shift discharge cells in the non-selected shift rows, and each said first voltage pulse is applied to the shift electrode opposing the write electrode of the non-selected rows within a particular selected one of said steps for which shift cells of different ones of said phases in said selected shift rows and non-selected shift rows are activated.

6. A self shift type gas discharge panel having a plurality of shift channels, for writing and shifting discharge spots representing information to be displayed into at least one selected one of said shift channels, said shifting occurring by repeated shift operation periods, said panel comprising each said shift channel comprising a periodic arrangement of shift discharge cells formed by a regular arrangement of shift electrodes of plural groups, with a write electrode for forming a write discharge cell at the same end of each said shift channel, and control means for controlling said shifting of discharge spots by applying a repeated plurality of waveforms to said shift discharge cells to define a repeated plurality of phases of said shift discharge cells along each said shift channel, said control means including means for providing a total write sequence, prior to application of write voltage pulses corresponding to said information to be displayed to the respective ones of said write electrodes for said writing and shifting into each said selected shift channel, said total write sequence including:

(a) generating discharge spots at all of said shift cells of each said selected shift channel by applying an ignite voltage pulse across all of said shift discharge cells of each said selected shift channel, (b) after the discharge spots are generated at all the shift discharge cells of each said selected shift channel, erasing each of the discharge spots by applying an erase voltage pulse across each said shift discharge cell of each selected shift channel, and (c) after the discharge spots at all the shift discharge cells of each selected shift channel disappear, temporarily generating write discharge spots at the write discharge cells of each selected shift channel by applying respective write voltage pulses to said write electrodes, and for thereafter sequentially applying respective voltage pulses for backward shift for at least one shift operation period across said shift discharge cells of each said selected shift channel, wherein any unwanted erroneous discharge spots induced at least at the shift discharge cells of the selected shift channels of the same phase as the write cells and closest thereto are caused to disappear.

7. A multi-row self shift type gas discharge panel having a plurality of shift channels for each said row and comprising two Y electrode groups arranged alternately along each said shift channel on a first substrate, two X electrode groups on a second substrate and arranged in such a manner as to alternately bridge the opposing Y electrodes of the respective Y electrode groups on the first substrate, and an ionizable gas sealed in a discharge space between the X and Y electrode groups, wherein said Y electrode groups and X electrode groups provide between them a periodic arrangement of shift discharge cells for defining the shift channels of each said row, with the two Y electrode groups of all the shift channels of each said row being connected commonly, and said two X electrode groups being connected in common to the respective X electrodes of all the rows, said panel further comprising write electrodes forming write discharge cells at one end of said shift channels, and control means for applying shift pulses to said groups of electrodes to define a predetermined sequence of phases corresponding to said periodic arrangement of discharge cells in each said shift channel, said control means including means for providing a total write sequence, prior to the application of write voltage pulses corresponding to information to be written into at least one selected one of said rows, wherein said total write sequence includes:

(a) applying ignite voltage pulses to the two X electrode groups when the two Y electrode groups of said at least one selected row are at a reference voltage, and, simultaneously with the ignite voltage pulses, applying shift voltage pulses of the same polarity as said ignite voltage pulses and of at least the same time width to the two Y electrode groups of each said shift channel of each non-selected row, wherein discharge spots are generated only at all the shift discharge cells of each selected row;

(b) after the discharge spots are generated at all said shift discharge cells of the selected shift rows, applying shift voltage pulses to said two X electrode groups and further shift voltage pulses, having a predetermined phase difference with respect to the voltage pulses supplied to said X electrode groups, to the two Y electrode groups of the shift channels of each selected row, wherein erase voltage pulses for erasing the discharge spots are effectively supplied to all the shift cells of each selected row; and (c) after erasing the discharge spots at all the shift discharge cells of each selected row, temporarily generating discharge spots at the write discharge cells of each selected row by applying a write voltage pulse to the respective write electrodes, and thereafter applying predetermined shift voltage pulses for backward shift operation in a predetermined sequence to said two X electrode groups and to the two Y electrode groups of each said selected row, wherein any unwanted erroneous discharge spot that is thereby induced at the shift cell of a shift channel of selected row and of the same phase as the write cell and closest thereto is caused to disappear.

8. The system of claim 7, wherein corresponding ones of the write electrodes in all the shift rows are connected in common, and said control means incuding means for applying a shift voltage pulse of the same polarity as said write voltage pulse and of at least the same time width to the shift electrode opposing each write electrode across said gas discharge space of the non-selected shift rows, as a result of which discharge spots in the write discharge cells of the non-selected shift rows are prevented.

9. The panel of claim 1, 2 or 3, comprising a first substrate on which all of the electrodes of the groups of said second set are formed, and a second substrate on which said write electrodes and the electrodes of each said group of said first set are formed to define each said shift and write cell across the discharge space between said first and second substrates.

10. The panel of claim 9, comprising two of said groups of electrodes of said first set, and two of said groups of electrodes of said second set, wherein said shifting and displaying are accomplished by selectively applying four predetermined pulse trains to said electrode groups during each of said four steps.

11. The panel of claim 4, comprising a first substrate on which all of the electrodes of the groups of said second set are formed, and a second substrate on which said write electrodes and the electrodes of each said group of said first set are formed to define each said shift and write cell across the discharge space between said first and second substrates.

12. The panel of claim 11, comprising two of said groups of electrodes of said first set, and two of said groups of said second set, wherein said shifting and displaying are accomplished by selectively applying four predetermined pulse trains to said electrode groups during each of said four steps.

13. The panel of claim 5, comprising a first substrate on which all of the electrodes of the groups of said second set are formed, and a second substrate on which said write electrodes and the electrodes of each said group of said first set are formed to define each said shift and write cell across the discharge space between said first and second substrates.

14. The panel of claim 13, comprising two of said groups of electrodes of said first set, and two of said groups of said second set, wherein said shifting and displaying are accomplished by selectively applying four predetermined pulse trains to said electrode groups during each of said four steps.

15. The panel of claim 1, 2 or 3, said control means comprising means for, prior to writing information into each said selected row, discharging all said shift discharge cells of each shift channel of each selected row, erasing the discharge spots at all said shift discharge cells of each shift channel of each selected row, and supplying pulses for backward shifting any discharges in each said selected row, while sway shifting each said discharge spot in each non-selected row.

16. The panel of claim 4, wherein there are four discharge cells of four different phases in each said period of said periodic sequence and the shifting and displaying of information includes said control means providing shift pulses to said groups of shift electrodes with a repeated period of four steps per period for said shifting and displaying of information, so that discharge spots are written and shifted in the forward direction along the shift channels of each selected shift row, discharge spots are sway-shifted within one period of said periodic sequence of said shift discharge cells in the non-selected shift rows, and each said first voltage pulse is applied to the shift electrode opposing the write electrode of the non-selected rows within a particular selected one of said steps for which shift cells of different ones of said phases in said selected shift rows and non-selected shift rows are activated.

17. The panel of claim 16, said control means comprising means for, prior to writing information into each said selected row, erasing the discharge spots at all said shift discharge cells of each shift channel of each row, and supplying shift pulses for backward shifting any discharges in each said selected row and for simultaneously sway shifting each discharge spot in each non-selected row.

18. The panel of claim 1, 2 or 3 said shift pulses that are applied to said groups of shift electrodes comprising a set of basic waveforms that are repeatedly applied in predetermined sequences according to said different phases of said shift discharge cells, wherein one of said basic waveforms are selected for said first voltage pulses.

19. The panel of claim 2, wherein said control means provides said shift pulses and said first and second voltage pulses in the form of a predetermined number of basic waveforms that are repeatedly applied to the respective groups depending on which of said rows are selected.

20. The panel of claim 19, said first set comprising two of said groups of electrodes and said second set comprising two of said groups of electrodes, wherein said control means provides four of said basic waveforms as said shift pulses and said first and second voltage pulses.

21. The panel of claim 20, at least three of said four basic waveforms being the same exept that at least one of the third and fourth of said basic waveforms is shifted in time with respect to the first two.

22. The panel of claim 5, each said shift pulse and each said voltage pulse that is applied to said groups of shift electrodes for said writing, shifting and displaying of said information being formed of a set of four basic waveforms that are repeatedly applied in predetermined order to respective ones of said groups of electrodes to forward shift the discharge spots in each said selected row while sway-shifting the discharge spots in each said non-selected row.

23. The panel of claim 22, all four of said basic waveforms being the same, and at least one of said basic waveforms being shifted in time with respect to the first two basic waveforms.

24. A self-shift type of discharge panel comprising a plurality of shift channels, each said shift channel being formed by a respective plurality of discharge cells defined between opposing portions of respective electrodes, selected alternating ones of said electrodes along each said shift channel being connected in common, and selected alternating other ones of said electrodes in all said shift channels being commonly connected, so as to define a periodic sequence of said shift cells depending on which of said groups of electrodes are included in said shift cells, each said shift channel having at an end thereof a write electrode opposing a respective portion of a respective one of said shift electrodes so as to provide a write cell therebetween, control means for selectively writing and shifting information in the form of discharge spots into at least one selected one of said shift channels, while displaying previously written discharge spots in the non-selected shift channels, by applying selected write voltage pulses to said write electrodes and respective sequences of shift voltage pulse to each said group of shift electrodes, wherein respective phases are associated with each said periodic sequence of shift cells, each said sequence of shift voltage pulses repeating itself according to the shifting of said information along each said period of said shift channels and according to said selected and non-selected shift channels, said control means including over-write avoiding means for preventing erroneous discharging of said shift cells when writing said information into said write cells, the operation of said over-write avoiding means involving the selective supplying of voltage pulses to said write electrodes and said groups of shift electrodes.

25. The panel of claim 24, comprising a respective plurality of said shift channels being grouped in each of a plurality of rows, all of the respective electrodes of all the shift channels in each said row being commonly connected, and said voltage pulses being provided to the shift electrodes opposite the write electrodes in the non-selected rows.

26. The panel of claim 24, said pulses being applied to the first electrode in all of said shift channels which, together with an opposing portion of the respective electrode whose other portion forms part of the write cell.

27. The panel of claim 24, 25 or 26, said control means comprising means for providing a total write sequence.

* * * * *

UNITED STATES PATENT AND TRADEMARK OFFICE

CERTIFICATE OF CORRECTION

PATENT NO. : 4,458,244

DATED : July 3, 1984

INVENTOR(S) : HISHASHI YAMAGUCHI et al

It is certified that error appears in the above-identified patent and that said Letters Patent is hereby corrected as shown below:

Column 1, before the title insert --Title of the Invention--.

Column 3, line 20, delete "in";
line 40, "said" should be --the--;
line 41, "spots" should be --spots--.

Column 4, line 30, "w'" should be --w,--.

Column 5, line 45, delete "shows".

Column 6, line 25, "way" should be --sway--.

Column 7, line 17, after "as" insert --to--;
line 67, "1" should be -- 1 --; "4" should be -- 4 --.

Column 8, line 3, " 4 only" should be -- 4 only,--;
line 3, after "operation" insert--, that are--;
line 4, delete "and shift operation";
line 7, delete ",".

Column 9, line 10, after "input" insert --,--;
line 15, after "input" insert --,--.

Column 10, line 36, "quickening" should be --advancing--;
line 40, "quickening" should be --advancing--.

UNITED STATES PATENT AND TRADEMARK OFFICE

CERTIFICATE OF CORRECTION

PATENT NO. : 4,458,244

DATED : July 3, 1984

INVENTOR(S) : HISASHI YAMAGUCHI et al

It is certified that error appears in the above-identified patent and that said Letters Patent is hereby corrected as shown below:

Column 13, line 37, after "$\tau_e$" delete --,--.

Signed and Sealed this

*Nineteenth* Day of *February 1985*

[SEAL]

*Attest:*

DONALD J. QUIGG

*Attesting Officer*

*Acting Commissioner of Patents and Trademarks*